US008398819B2

(12) United States Patent
Yeh et al.

(10) Patent No.: US 8,398,819 B2
(45) Date of Patent: Mar. 19, 2013

(54) METHOD OF MOIST CREPING ABSORBENT PAPER BASE SHEET

(75) Inventors: Kang Chang Yeh, Neenah, WI (US); Christopher J. Peters, Denmark, WI (US); Mark S. Hunter, Green Bay, WI (US); Daniel J. Geddes, Appleton, WI (US); Hung Liang Chou, Neenah, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 0 days.

(21) Appl. No.: 12/961,546

(22) Filed: Dec. 7, 2010

(65) Prior Publication Data

US 2011/0146924 A1 Jun. 23, 2011

Related U.S. Application Data

(60) Provisional application No. 61/283,648, filed on Dec. 7, 2009.

(51) Int. Cl.
*B31F 1/12* (2006.01)

(52) U.S. Cl. ..... 162/111

(58) Field of Classification Search ..... 162/111, 162/112, 113; 156/183; 264/283
See application file for complete search history.

(56) References Cited

U.S. PATENT DOCUMENTS

| | | | |
|---|---|---|---|
| 1,971,951 | A | 8/1934 | Skirrow et al. |
| 2,109,883 | A | 3/1938 | Herrmann et al. |
| 2,926,116 | A | 2/1960 | Keim |
| 2,954,868 | A | 10/1960 | Swedish, Jr. et al. |
| 3,058,873 | A | 10/1962 | Keim |
| 3,476,644 | A | 11/1969 | Krehnbrink |
| 3,556,932 | A | 1/1971 | Coscia et al. |
| 3,556,933 | A | 1/1971 | Williams et al. |
| 3,700,623 | A | 10/1972 | Keim |
| 3,772,076 | A | 11/1973 | Keim |
| 3,974,025 | A | 8/1976 | Ayers |
| 3,994,771 | A | 11/1976 | Morgan, Jr. et al. |
| 4,102,737 | A | 7/1978 | Morton |
| 4,239,065 | A | 12/1980 | Trokhan |
| 4,440,597 | A | 4/1984 | Wells et al. |
| 4,448,638 | A | 5/1984 | Klowak |
| 4,482,429 | A | 11/1984 | Klowak |
| 4,490,925 | A | 1/1985 | Smith |
| 4,528,316 | A | 7/1985 | Soerens |
| 4,529,480 | A | 7/1985 | Trokhan |
| 4,551,199 | A | 11/1985 | Weldon |
| 4,603,176 | A | 7/1986 | Bjorkquist et al. |
| 4,605,702 | A | 8/1986 | Guerro et al. |
| 4,675,394 | A | 6/1987 | Solarek et al. |
| 4,689,119 | A | 8/1987 | Weldon |
| 4,720,383 | A | 1/1988 | Drach et al. |
| 4,804,769 | A | 2/1989 | Solarek et al. |
| 4,834,838 | A | 5/1989 | Klowak |
| 4,849,054 | A | 7/1989 | Klowak |
| 4,866,151 | A | 9/1989 | Tsai et al. |
| 4,981,557 | A | 1/1991 | Bjorkquist |
| 4,983,748 | A | 1/1991 | Tsai et al. |
| 4,992,140 | A | 2/1991 | Anderson et al. |
| 5,008,344 | A | 4/1991 | Bjorkquist |
| 5,085,736 | A | 2/1992 | Bjorkquist |
| 5,138,002 | A | 8/1992 | Bjorkquist |
| 5,217,576 | A | 6/1993 | Van Phan |
| 5,223,096 | A | 6/1993 | Phan et al. |
| 5,240,562 | A | 8/1993 | Phan et al. |
| 5,262,007 | A | 11/1993 | Phan et al. |
| 5,264,082 | A | 11/1993 | Phan et al. |
| 5,312,522 | A | 5/1994 | Van Phan et al. |
| 5,314,584 | A | 5/1994 | Grinnell et al. |
| 5,377,428 | A | 1/1995 | Clark |
| 5,415,737 | A | 5/1995 | Phan et al. |
| 5,449,026 | A | 9/1995 | Lee |
| 5,494,554 | A | 2/1996 | Edwards et al. |
| 5,601,871 | A | 2/1997 | Krzysik et al. |
| 5,607,551 | A | 3/1997 | Farrington, Jr. et al. |
| 5,614,293 | A | 3/1997 | Krzysik et al. |
| 5,656,134 | A | 8/1997 | Marinack et al. |
| 5,660,687 | A | 8/1997 | Allen et al. |
| 5,667,636 | A | 9/1997 | Engel et al. |
| 5,685,954 | A | 11/1997 | Marinack et al. |
| 5,690,149 | A | 11/1997 | Lee |
| 5,690,788 | A | 11/1997 | Marinack et al. |
| 5,720,966 | A | 2/1998 | Ostendorf |
| 5,781,942 | A | 7/1998 | Allen et al. |
| 5,830,487 | A | 11/1998 | Klofta et al. |
| 5,833,806 | A | 11/1998 | Allen et al. |
| 5,871,763 | A | 2/1999 | Luu et al. |
| 5,885,415 | A | 3/1999 | Marinack et al. |
| 5,885,416 | A | 3/1999 | Marinack et al. |
| 5,885,417 | A | 3/1999 | Marinack et al. |
| 5,888,347 | A | 3/1999 | Engel et al. |

(Continued)

FOREIGN PATENT DOCUMENTS

| | | | |
|---|---|---|---|
| EP | 0875233 | A1 | 11/1998 |
| EP | 1070785 | A2 | 1/2001 |

(Continued)

OTHER PUBLICATIONS

Search Report for European Application No. 10193311.7 that issued May 31, 2011.

(Continued)

*Primary Examiner* — Mark Halpern
(74) *Attorney, Agent, or Firm* — Laura L. Bozek

(57) ABSTRACT

A method of moist creping absorbent paper base sheet includes forming a nascent web including at least a major portion of flattened ribbonlike cellulosic fibers of recycled fiber. A creping adhesive coating including an admixture of polyvinyl alcohol and a polyamide crosslinked with epichlorohydrin is applied to a Yankee dryer. The nascent web is passed through a nip, defined between a suction pressure roll and the Yankee dryer, having a controlled loading. The nascent web is adhered to the Yankee dryer and dried on the Yankee dryer to a moisture content corresponding to a sheet temperature, immediately prior to the creping blade, of from about 110° C. to about 121° C. The nascent web is creped at a sheet temperature of from about 110° C. to about 121° C. from the Yankee dryer with an undulatory creping blade bearing against the Yankee dryer to form a moist biaxially undulatory web, which is dried.

48 Claims, 7 Drawing Sheets

U.S. PATENT DOCUMENTS

| | | | |
|---|---|---|---|
| 5,908,533 | A | 6/1999 | Marinack et al. |
| 5,945,910 | A | 8/1999 | Gorra |
| 6,096,168 | A | 8/2000 | Marinack et al. |
| 6,187,137 | B1 | 2/2001 | Druecke et al. |
| 6,287,426 | B1 | 9/2001 | Edwards et al. |
| 6,321,963 | B1 | 11/2001 | Gracyalny et al. |
| 6,336,995 | B1 | 1/2002 | Campbell |
| 6,350,349 | B1 | 2/2002 | Hermans et al. |
| 6,352,700 | B1 | 3/2002 | Luu et al. |
| 6,379,496 | B2 | 4/2002 | Edwards et al. |
| 6,412,678 | B2 | 7/2002 | Gracyalny et al. |
| 6,425,983 | B1 | 7/2002 | Marinack et al. |
| 6,451,166 | B1 | 9/2002 | Marinack et al. |
| 6,511,579 | B1 | 1/2003 | Edwards et al. |
| 6,540,879 | B2 | 4/2003 | Marinack et al. |
| 6,592,067 | B2 | 7/2003 | Denen et al. |
| 6,709,548 | B2 | 3/2004 | Marinack et al. |
| 6,733,773 | B1 | 5/2004 | Hsu et al. |
| 6,766,977 | B2 | 7/2004 | Denen et al. |
| 6,793,170 | B2 | 9/2004 | Denen et al. |
| 6,838,887 | B2 | 1/2005 | Denen et al. |
| 6,871,815 | B2 | 3/2005 | Moody et al. |
| 7,048,826 | B2 | 5/2006 | Archer et al. |
| 7,169,400 | B2 | 1/2007 | Luu et al. |
| 7,361,361 | B2 | 4/2008 | Luu et al. |
| 7,404,875 | B2 | 7/2008 | Clungeon et al. |
| 7,585,388 | B2 | 9/2009 | Yeh et al. |
| 7,608,164 | B2 | 10/2009 | Chou et al. |
| 2001/0007278 | A1 | 7/2001 | Edwards et al. |
| 2002/0061500 | A1 | 5/2002 | Collopy |
| 2004/0060675 | A1 | 4/2004 | Archer et al. |
| 2004/0177940 | A1 | 9/2004 | Archer et al. |
| 2004/0211534 | A1 | 10/2004 | Clungeon et al. |
| 2005/0006040 | A1 | 1/2005 | Boettcher et al. |
| 2005/0217814 | A1 | 10/2005 | Super et al. |
| 2005/0245669 | A1 | 11/2005 | Clungeon et al. |
| 2006/0110432 | A1 | 5/2006 | Luu et al. |
| 2006/0289133 | A1 | 12/2006 | Yeh et al. |
| 2007/0204966 | A1 | 9/2007 | Chou et al. |
| 2007/0237807 | A1 | 10/2007 | Luu et al. |
| 2008/0008865 | A1 | 1/2008 | Luu et al. |
| 2008/0105394 | A1 | 5/2008 | Kokko |
| 2008/0107698 | A1 | 5/2008 | Luu et al. |
| 2008/0245492 | A1 | 10/2008 | Edwards et al. |

FOREIGN PATENT DOCUMENTS

| | | | |
|---|---|---|---|
| EP | 1356923 | A1 | 10/2003 |
| WO | 02/41869 | A2 | 5/2002 |
| WO | 2007/001837 | A2 | 1/2007 |
| WO | 2008/106344 | A1 | 9/2008 |

OTHER PUBLICATIONS

W. P. Evans, Cationic Fabric Softeners, Chemistry and Industry, Jul. 5, 1969, pp. 893-903.

R. R. Egan, Cationic Surface Active Agents as Fabric Softeners, J. Am. Oil Chemist's Soc., 1978, pp. 118-121, vol. 55.

Lars Westfelt, Chemistry of Paper Wet Strength I. A. Survey of Mechanisms of Wet-Strength Development, Cellulose Chemistry and Technology, 1979, pp. 813-825, vol. 13.

B. C. Trivedi et al., Quaternization of Imidazoline: Unequivocal Structure Proof, J. Am. Oil Chemists' Soc., Jun. 1981, pp. 754-756.

T. Okaya, Modification of Polyvinyl Alcohol by Copolymerization, Polyvinyl Alcohol Developments, 1992, pp. 84-93, John Wiley & Sons Ltd., West Sussex, England.

Herbert H. Espy, Chapter 2: Alkaline-Curing Polymeric Amine-Epichlorohydrin Resins, Wet Strength Resins and Their Application, 1994, pp. 13-44, L. Chan, Editor.

METHOD OF MOIST CREPING ABSORBENT PAPER BASE SHEET

CLAIM FOR PRIORITY

This non-provisional application is based upon U.S. Provisional Patent Application No. 61/283,648, of the same title, filed Dec. 7, 2009. The priority of U.S. Provisional Patent Application No. 61/283,648 is hereby claimed and the disclosure thereof is incorporated into this application by reference.

BACKGROUND

Toweling for automatic dispensers similar to those disclosed in U.S. Pat. No. 6,766,977 must reconcile several competing requirements—it must be reasonably lightweight and low in caliper, yet feel substantial and reasonably soft when used for hand drying. As disclosed in United States Patent Application Publication No. 2006/0289133, which issued as U.S. Pat. No. 7,585,388 on Sep. 8, 2009, a machine-direction (MD) bending length of at least about 3.5 cm may be required for the most reliable dispensing. It should provide sufficient absorbency and absorbent rate that most users will be satisfied to dry their hands with a single sheet, as by far, the most important requirement is that it have a low cost in use. Accordingly, cost constraints strongly encourage the use of recycle fiber, which adds immense difficulties in obtaining a satisfactory combination of properties, as recycled fibers not only contain higher proportions of fines, but are also often more ribbonlike than cylindrical, the ease with which ribbonlike fibers bond strongly to each other tending to result in an undesirably strong sheet, compromising the softness of the sheet, but more importantly, making it difficult to attain satisfactorily high values of absorbency and wipe dry properties. After all, if users typically require several sheets to achieve satisfactory dryness, the raison d'etre of the automated dispenser is entirely defeated, at least from the point of view of the customer, who is typically very sensitive to cost, in use. To further aggravate matters, rather than employing through-air drying techniques, which typically imply both higher operating costs and higher capital costs, it is highly desirable economically to dry the sheets, particularly, those containing recycle fibers, on a Yankee cylinder; but, again, this often conflicts with obtaining the desired absorbency. Accordingly, sheets dried on a Yankee are usually creped to open up the sheet, adding softness and absorbency to what otherwise would be largely unsatisfactory for absorbent purposes. Traditionally, toweling grades have either been creped wet or dry, with dry creping often being conducted at consistencies of 95%, and more, while wet creping is more typically conducted at consistencies of between around 50% to 80%. When sheets are creped from Yankee cylinders, adhesive is typically used to secure the web to the Yankee. Typically, creping is accomplished using any of a variety of combinations of a very wide variety of adhesives and additives including, but far from limited to, polyacrylamide, polyaminoamide, polyvinylalcohol or polyamide epichlorohydrin resins, along with release agents, to carefully modulate the degree of adhesion between the web and the Yankee (see, for example, U.S. Pat. No. 6,511,579). Similarly, a wide variety of creping configurations has been suggested.

SUMMARY OF THE INVENTION

The present inventors have discovered that toweling with surprisingly high absorbency can be attained using a furnish comprising a major proportion of recycle furnish, if that furnish is creped:

(i) from a Yankee dryer coated with a creping adhesive comprising polyvinyl alcohol and an epichlorohydrin crosslinked polyamide creping adhesive;

(ii) at a consistency corresponding to a sheet temperature (immediately prior to the creping blade) of between 225° F. (107° C.) and 255° F. (124° C.), preferably, ranging from about 230° F. (110° C.) up to about 250° F. (121° C.); and (iii) using an undulatory crepe blade such as that disclosed in U.S. Pat. No. 5,690,788, in which the contact area between the blade and the Yankee dryer takes the shape of an undulatory ribbon extending across the width of the Yankee cylinder.

More particularly, the present invention relates to a method of moist creping absorbent paper base sheet by forming a nascent web comprising at least a major portion, on a length weighted basis, of flattened ribbonlike cellulosic fibers (as observed in the dry state), applying a creping adhesive coating comprising an admixture of polyvinyl alcohol and a polyamide crosslinked with epichlorohydrin to a Yankee dryer, passing the nascent web through a nip defined between a suction pressure roll and the Yankee dryer, adhering the nascent web to the Yankee dryer with a pressure controlled by controlling the loading between the suction pressure roll and the Yankee dryer, drying the nascent web on the Yankee dryer to a moisture content corresponding to a sheet temperature (immediately prior to the creping blade) of between 225° F. and 255° F. (107° C. and 124° C.), preferably, ranging from about 230° F. up to about 250° F. (110° C. to 121° C.), creping the nascent web sheet at a sheet temperature (immediately prior to the creping blade) of between 225° F. and 255° F. (107° C. and 124° C.) from the Yankee dryer with an undulatory creping blade bearing against the Yankee dryer to form a moist biaxially undulatory web, the contact area between the undulatory creping blade and the Yankee dryer defining an undulatory ribbon shape across the width of the Yankee dryer, and, thereafter, drying the moist biaxially undulatory web to form a sheet having a geometric mean breaking length of from about 900 m to about 1350 m. Preferably, the steam pressure within the Yankee dyer, the hood parameters, the Yankee speed, the creping adhesive composition and the pressure with which the suction pressure roll bears against the Yankee dryer are controlled such that the geometric mean breaking length of the resulting web is between 1000 m and 1250 m, the basis weight of the dry biaxially undulatory web is less than 30 lbs/3000 $ft^2$, the caliper of the web exceeds 48 mils per 8 sheets, for unbleached toweling, the specific absorbency (SAT) (also known as WAC, water absorbent capacity) of the biaxially undulatory base sheet is at least 2.20 g/g and the WAR ("water absorbency rate") is less than 50 seconds, while for sheets having an ash content exceeding 1.5%, such as for bleached towels or white toweling, the SAT is at least 2.0 g/g and the WAR is less than 55 seconds. For best dispensing, in connection with an automatic dispenser, it is preferred that the machine direction (MD) bending length of the resulting web is at least 3.0 cm. In a more preferred embodiment, the specific SAT absorbency of the unbleached biaxially undulatory base sheet is at least 2.3 g/g, the basis weight of the dry biaxially undulatory web is between 24 and 30 lbs/3000 $ft^2$, the caliper of the web exceeds 50 mils per 8 sheets, and the WAR is less than 45 seconds. For good anti-tabbing performance, it is preferred that the CD wet tensile measured by the Finch cup method is at least 650 g/3", preferably, at least about 700 g/3", more preferably, 750 g/3", most preferably, 800 g/3". In the most economical embodiments, the web comprises at least about 75%, more preferably, at least about 90%, on a length weighted basis of flattened ribbonlike fibers.

Another preferred embodiment relates to a method of moist creping absorbent paper base sheet comprising the steps of forming a nascent web comprising at least a major portion, on a length weighted basis, of flattened ribbonlike cellulosic fibers, applying a creping adhesive coating comprising an admixture of polyvinyl alcohol and a polyamide crosslinked with epichlorohydrin to a Yankee dryer, passing the nascent web through a nip defined between a suction pressure roll and the Yankee dryer, adhering the nascent web to the Yankee dryer with a controlled pressure between the suction pressure roll and the Yankee dryer, drying the nascent web on the Yankee dryer to a moisture content corresponding to a sheet temperature (immediately prior to the creping blade) between 225° F. and 255° F. (107° C. and 121° C.), preferably, ranging from about 230° F. (110° C.) up to about 250° F. (121° C.), creping the nascent web from the Yankee dryer at a sheet temperature between 225° F. and 255° F. (107° C. and 124° C.), preferably, ranging from about 230° F. (110° C.) up to about 250° F. (121° C.) with a creping blade bearing against the Yankee dryer to form a moist web, and thereafter, drying the moist web to form a sheet having a geometric mean breaking length of from about 900 m to about 1350 m. Still, more preferably, the geometric mean breaking length of the toweling is from about 950 m to about 1300 m. Most preferably, the creping temperature is from about 235° F. (113° C.) to about 245° F. (118° C.) and the geometric mean breaking length of the toweling is from about 1100 m to about 1250 m.

Another preferred embodiment relates to a method of moist creping absorbent paper base sheet comprising the steps of forming a nascent web comprising at least a major portion of flattened ribbonlike cellulosic fibers, applying a creping adhesive coating to a Yankee dryer, passing the nascent web through a nip defined between a suction pressure roll and the Yankee dryer, adhering the nascent web to the Yankee dryer with a pressure controlled by controlling the loading between the suction pressure roll and the Yankee dryer, drying the nascent web on the Yankee dryer to a moisture content corresponding to a sheet temperature (immediately prior to the creping blade) of between 230° F. and 250° F. (110° C. and 121° C.), creping the nascent web at a sheet temperature of between 230° F. and 250° F. (110° C. and 121° C.) from the Yankee dryer with an undulatory creping blade bearing against the Yankee dryer to form a moist biaxially undulatory web, the contact area between the undulatory creping blade and the Yankee dryer defining an undulatory ribbon shape across the width of the Yankee dryer, and, thereafter, drying the moist biaxially undulatory web.

Another preferred embodiment relates to a method of moist creping absorbent paper base sheet comprising the steps of forming a nascent web comprising at least a major portion of cellulosic fibers, applying a creping adhesive coating comprising an admixture of polyvinyl alcohol and a polyamide crosslinked with epichlorohydrin to a Yankee dryer, passing the nascent web through a nip defined between a suction pressure roll and the Yankee dryer, adhering the nascent web to the Yankee dryer with a controlled pressure loading between the suction pressure roll and the Yankee dryer, drying the nascent web on the Yankee dryer to a moisture content corresponding to a sheet temperature (immediately prior to the creping blade) of between 230° F. and 250° F. (110° C. and 121° C.), creping the nascent web at a sheet temperature of between 230° F. and 250° F. (110° C. and 121° C.) from the Yankee dryer with an undulatory creping blade bearing against the Yankee dryer to form a moist biaxially undulatory web, the contact area between the undulatory creping blade and the Yankee dryer defining an undulatory ribbon shape across the width of the Yankee dryer, and, thereafter, drying the moist biaxially undulatory web and recovering a web comprising at least about 1.5% ash by weight and at least about 10% non-hardwood fibers, having an average fiber length of less than about 0.2 mm on a length weighted basis.

Another preferred embodiment relates to a method of moist creping absorbent paper base sheet comprising the steps of forming a nascent web comprising at least a major portion of recycled cellulosic fibers, applying a creping adhesive coating comprising an admixture of polyvinyl alcohol and a polyamide crosslinked with epichlorohydrin to a Yankee dryer, passing the nascent web through a nip defined between a suction pressure roll and the Yankee dryer, adhering the nascent web to the Yankee dryer with a pressure controlled by controlling the loading between the suction pressure roll and the Yankee dryer, drying the nascent web on the Yankee dryer to a moisture content corresponding to a sheet temperature (immediately prior to the creping blade) of between 230° F. and 250° F. (110° C. and 121° C.), creping the nascent web at a sheet temperature of between 230° F. and 250° F. (110° C. and 121° C.) from the Yankee dryer with a creping blade bearing against the Yankee dryer to form a moist web, thereafter, drying the moist web, and recovering a web comprising at least about 1.5% ash by weight and at least about 10% non-hardwood fibers, having an average fiber length of less than about 0.2 mm on a weight weighted basis.

Another preferred embodiment relates to a method of moist creping absorbent paper basesheet comprising the steps of forming a nascent web comprising at least a major portion of recycled cellulosic fibers, applying a creping adhesive coating to a Yankee dryer, passing the nascent web through a nip defined between a suction pressure roll and the Yankee dryer, adhering the nascent web to the Yankee dryer with a pressure controlled by controlling the loading between the suction pressure roll and the Yankee dryer, drying the nascent web on the Yankee dryer to a moisture content corresponding to a sheet temperature (immediately prior to the creping blade) of between 230° F. and 250° F. (110° C. and 121° C.)., creping the nascent web at a sheet temperature of between 230° F. and 250° F. (110° C. and 121° C.) from the Yankee dryer with an undulatory creping blade bearing against the Yankee dryer to form a moist biaxially undulatory web, the contact area between the undulatory creping blade and the Yankee dryer defining an undulatory ribbon shape across the width of the Yankee dryer, thereafter, drying the moist biaxially undulatory web, and recovering a web comprising at least about 1.5% ash by weight and at least about 10% non hardwood fibers, having an average fiber length of less than about 0.2 mm on a weight weighted basis.

DETAILED DESCRIPTION

Figure 1:
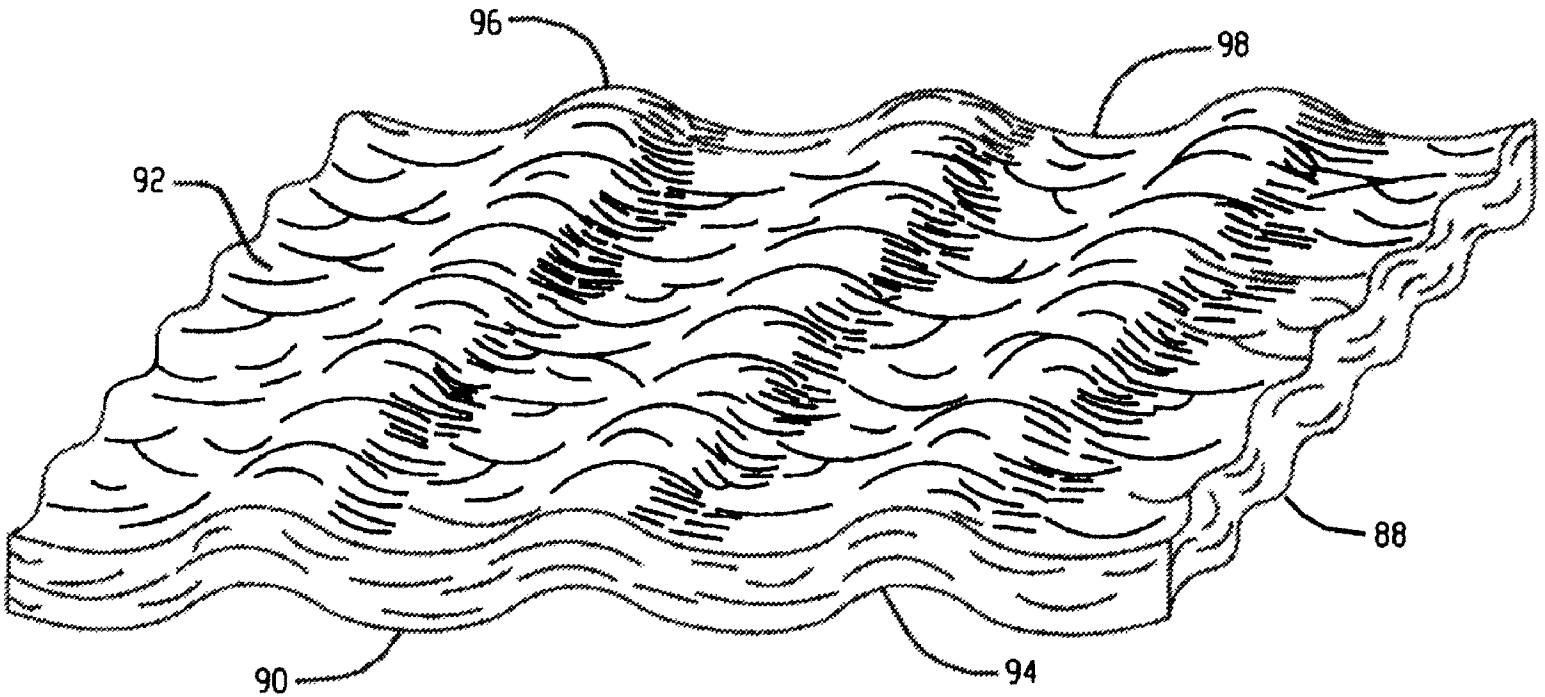
FIG. 1 schematically illustrates a biaxially undulatory sheet of the present invention.

The present invention relates to an extremely economical method of forming paper toweling from a very low cost furnish comprising at least a major proportion of recycled fiber, more preferably, at least about 75% recycled fiber as determined on a length-weighted basis and, most preferably, over 90% recycled fiber. In general, recycled fiber has only one attribute recommending it for use in making absorbent toweling—low cost. Recycled fibers generally become rather flattened and ribbonlike, making it quite easy to form overly strong, relatively nonporous sheets that are less than ideally-suited for toweling, as they tend to have low absorbency and low softness. Further, recycled furnishes tend to have large proportions of fines and, typically, include a considerable amount of ash. Fines also contribute to excessive strength in the sheet, while the presence of ash is thought by many, in some instances, to interfere with drainage of water from the furnish during the sheet forming process. Inasmuch as the drainage length on most paper machines is fixed, reduction in the use of sufficient water to ensure good formation often contributes to a "papery feel". We are able to counter this papery feel, at least in part, by use of an undulatory creping blade. Further, those recycled papers containing large amounts of ash are generally sold at a discount relative to lower ash sources. As shown hereafter, the method of the present invention ameliorates these undesirable qualities of recycled furnish, making it possible to achieve levels of absorbency and softness equaling or surpassing those of many previously known grades of toweling made from recycled fiber.

Terminology used herein is given its ordinary meaning consistent with the exemplary definitions set forth immediately below, mg refers to milligrams and $m^2$ refers to square meters, and so forth. Unless otherwise specified, test specimens are prepared under standard TAPPI conditions, that is, conditioned in an atmosphere of 23°±1.0° C. (73.4°±1.8° F.) at 50% relative humidity for at least about 2 hours.

Throughout this specification and claims, when we refer to a nascent web having an apparently random distribution of fiber orientation (or use like terminology), we are referring to the distribution of fiber orientation that results when known forming techniques are used for depositing a furnish on the forming fabric. When examined microscopically, the fibers give the appearance of being randomly oriented, even though, depending on the jet to wire speed, there may be a significant bias toward machine direction orientation, making the machine direction tensile strength of the web exceed the cross-direction tensile strength.

Unless otherwise specified, "basis weight", BWT, bwt, and so forth, refers to the weight of a 3000 square foot ream of product. Consistency refers to percent solids of a nascent web, for example, calculated on a bone dry basis. "Air dry" means including residual moisture, by convention, up to about 6% for paper. A nascent web having 30 percent water and 70 percent bone dry pulp has a consistency of 70 percent.

The term "cellulosic", "cellulosic sheet," and the like, is meant to include any product incorporating papermaking fiber having cellulose as a major constituent. "Papermaking fibers" include virgin pulps or recycle (secondary) cellulosic fibers or fiber mixes comprising cellulosic fibers. Fibers suitable for making the webs of this invention include nonwood fibers, such as cotton fibers or cotton derivatives, abaca, kenaf, sabai grass, flax, esparto grass, straw, jute hemp, bagasse, milkweed floss fibers, and pineapple leaf fibers, and wood fibers, such as those obtained from deciduous and coniferous trees, including softwood fibers, such as northern and southern softwood kraft fibers, hardwood fibers, such as hardwood, maple, birch, aspen, or the like. Papermaking fibers can be liberated from their source material by any one of a number of chemical pulping processes familiar to one experienced in the art including sulfate, sulfite, polysulfide, soda pulping, etc. The pulp can be bleached, if desired, by chemical means, including the use of chlorine, chlorine dioxide, oxygen, alkaline peroxide, and so forth. The products of the present invention may comprise a blend of conventional fibers (whether derived from virgin pulp or recycle sources) and high coarseness lignin-rich tubular fibers, such as bleached chemical thermomechanical pulp (BCTMP). "Furnish" and like terminology refers to aqueous compositions including papermaking fibers, optionally, wet strength resins, debonders, and the like, for making paper products.

Throughout this specification and claims where the term "recycle fiber" is used, we are referring to fiber having the typical characteristics of recycled fiber, that at least a major portion, preferably, over 60%, more preferably, over 70%, and most preferably, over 80% of the fibers, as determined on a length weighted basis, exhibit the flattened ribbon like configuration typical of fibers that have been reused. In some cases, sheets made from recycle fibers can be recognized as such based on the presence of at least 10%, as determined on a length weighted basis, of non-hardwood fines under 0.2 mm in length and at least about 1.5% ash in the finished sheet. In most cases, all three criteria will be satisfied, but percentage of flattened ribbonlike fiber and/or percent fines should be considered controlling for the purposes of this application, as indicated by the context. Unless otherwise indicated, "major portion", "over X %" and like terminology as used herein refers to length-weighted fiber length distribution of the pulp. Unless otherwise specified, the OpTest Fiber Quality Analyzer (FQA) from OpTest Equipment, Hawkesbury, Ontario, Canada, Model No. Code LDA 96, should be utilized to determine fiber length distribution. The analyzer is operated at standard settings, that is, the settings are for fibers 0.4 mm to 10 mm in length with curl indices from 0.5 to 10. The FQA measures individual fiber contour and projected lengths by optically imaging fibers with a CCD camera and polarized infrared light.

Calipers and/or bulk reported herein may be measured at 8 or 16 sheet calipers as specified. The sheets are stacked and the caliper measurement taken about the central portion of the stack. Preferably, the test samples are conditioned in an atmosphere of 23°±1.0° C. (73.4°±1.8° F.) at 50% relative humidity for at least about 2 hours and then measured with a Thwing-Albert Model 89-II-JR or Progage Electronic Thickness Tester with 2-in (50.8-mm) diameter anvils, 539±10 grams dead weight load, and 0.231 in/sec descent rate. For finished product testing, each sheet of product to be tested must have the same number of plies as the product as sold. For testing in general, eight sheets are selected and stacked together. For base sheet testing off of winders, each sheet to be tested must have the same number of plies as produced off the winder. For base sheet testing off of the papermachine reel, an assemblage of single plies must be used. Sheets are stacked together aligned in the MD. Bulk may also be expressed in units of volume/weight by dividing caliper by basis weight.

MD bending length (cm) is determined in accordance with ASTM test method D 1388-96, cantilever option. Reported bending lengths refer to MD bending lengths unless a cross-machine direction (CD) bending length is expressly specified. The MD bending length test was performed with a Cantilever Bending Tester available from Research Dimensions, 1720 Oakridge Road, Neenah, Wis., 54956, which is substantially the apparatus shown in the ASTM test method, item 6. The instrument is placed on a level stable surface, horizontal position being confirmed by a built in leveling bubble. The bend angle indicator is set at 41.5° below the level of the sample table. This is accomplished by setting the knife edge appropriately. The sample is cut with a one inch JD strip cutter available from Thwing-Albert Instrument Company, 14 Collins Avenue, W. Berlin, N.J. 08091. Six (6) samples are cut 1 inch×8 inch (2.54 cm×20.32 cm) machine direction specimens. Samples are conditioned at 23°±1° C. (73.4° F.±1.8° F.) at 50% relative humidity for at least two hours. For machine direction specimens, the longer dimension is parallel to the machine direction. The specimens should be flat, free of wrinkles, bends or tears. The Yankee side of the specimens are also labeled. The specimen is placed on the horizontal platform of the tester, aligning the edge of the specimen with the right hand edge. The movable slide is placed on the specimen, being careful not to change its initial position. The right edge of the sample and the movable slide should be set at the right edge of the horizontal platform. The movable slide is displaced to the right in a smooth, slow manner at approximately 5 inch/minute (12.7 cm/minute) until the specimen touches the knife edge. The overhang length is recorded to the nearest 0.1 cm. This is done by reading the left edge of the movable slide. Three specimens are preferably run with the Yankee side up and three specimens are preferably run with the Yankee side down on the horizontal platform. The MD bending length is reported as the average overhang length in centimeters divided by two to account for bending axis location. Bending length refers to MD bending length unless specified otherwise.

Absorbency of the inventive products is measured with a simple absorbency tester. The simple absorbency tester is a particularly useful apparatus for measuring the hydrophilicity and absorbency properties of a sample of tissue, napkins, or towel. In this test, a sample of tissue, napkins, or towel 2.0 inches (5.08 cm) in diameter is mounted between a top flat plastic cover and a bottom grooved sample plate. The tissue, napkin, or towel sample disc is held in place by a ⅛ inch (0.32 cm) wide circumference flange area. The sample is not compressed by the holder. De-ionized water at 73° F. (23° C.) is introduced to the sample at the center of the bottom sample plate through a 1 mm diameter conduit. This water is at a hydrostatic head of minus 5 mm. Flow is initiated by a pulse introduced at the start of the measurement by the instrument mechanism. Water is thus imbibed by the tissue, napkin, or towel sample from this central entrance point radially outward by capillary action. When the rate of water imbibation decreases below 0.005 gm water per 5 seconds, the test is terminated. The amount of water removed from the reservoir and absorbed by the sample is weighed and reported as grams of water per square meter of sample or grams of water per gram of sheet. In practice, an M/K Systems Inc. Gravimetric Absorbency Testing System is used. This is a commercial system obtainable from M/K Systems Inc., 12 Garden Street, Danvers, Mass., 01923. WAC or water absorbent capacity, also referred to as SAT, is actually determined by the instrument itself WAC is defined as the point where the weight versus time graph effectively has a "zero" slope, i.e., the sample has stopped absorbing. The termination criteria for a test are expressed in maximum change in water weight absorbed over a fixed time period. This is basically an estimate of zero slope on the weight versus time graph. The program uses a change of 0.005 g over a 5 second time interval as termination criteria, unless "Slow SAT" is specified, in which case, the cut off criteria is 1 mg in 20 seconds.

Water absorbency rate or WAR, is measured in seconds, and is the time it takes for a sample to absorb a 0.1 gram droplet of water disposed on its surface by way of an automated syringe. The test specimens are preferably conditioned at 23°±1° C. (73.4±1.8° F.) at 50% relative humidity. For each sample, four 3×3 inch (7.62×7.62 cm) test specimens are prepared. Each specimen is placed in a sample holder such that a high intensity lamp is directed toward the specimen. 0.1 ml of water is deposited on the specimen surface and a stop watch is started. When the water is absorbed, as indicated by lack of further reflection of light from the drop, the stopwatch is stopped and the time recorded to the nearest 0.1 seconds. The procedure is repeated for each specimen and the results averaged for the sample. WAR is measured in accordance with TAPPI method T-432 cm-99.

Dry tensile strengths (MD and CD), stretch, ratios thereof, modulus, break modulus, stress and strain are measured with a standard Instron test device or other suitable elongation tensile tester, which may be configured in various ways, typically, using 3 or 1 inch (7.62 or 2.54 cm) wide strips of tissue or towel, conditioned in an atmosphere of 23°±1° C. (73.4°±1° F.) at 50% relative humidity for 2 hours. The tensile test is run at a crosshead speed of 2 in/min (5.08 cm/min). Tensile strength is sometimes referred to simply as "tensile".

GM Break Modulus is expressed in grams/3 inches/% strain. % strain is dimensionless and units need not be specified. Tensile values refer to break values unless otherwise indicated. Tensile strengths are reported in g/3" at break. GM Break Modulus is thus:

$$[(\text{MD tensile/MD Stretch at break})\times(\text{CD tensile/CD Stretch at break})]^{1/2}.$$

Tensile ratios are simply ratios of the values determined by way of the foregoing methods. Unless otherwise specified, a tensile property is a dry sheet property.

The wet tensile of the tissue of the present invention is measured using a three-inch wide strip of tissue that is folded into a loop, clamped in a special fixture termed a Finch Cup, then immersed in a water. The Finch Cup, which is available from the Thwing-Albert Instrument Company of Philadelphia, Pa., is mounted onto a tensile tester equipped with a 2.0 pound (0.91 kg) load cell with the flange of the Finch Cup clamped by the tester's lower jaw and the ends of tissue loop clamped into the upper jaw of the tensile tester. The sample is immersed in water that has been adjusted to a pH of 7.0±0.1 and the tensile is tested after a 5 second immersion time using a crosshead speed of 2 in./min (5.08 cm/min). Values are divided by two, as appropriate, to account for the loop.

Wet/dry tensile ratios are expressed in percent by multiplying the ratio by 100.

PLI or pli means pounds force per linear inch.

Sheet temperature is the indicated readout of temperature taken of the sheet on the Yankee immediately prior to the creping blade using a Raynger ST infra-red thermometer with the emissivity setting of the IR thermometer set at 0.95. It should be noted that our data does not agree precisely with the suggested relationship between sheet temperature and moisture content alluded to in U.S. Pat. Nos. 5,494,554 and 5,377,428. We believe that the discrepancy may be explained by the difference in the weight of the web on the Yankees and the furnish composition, as those patents concern making tissue (bath or facial) weight sheets from virgin furnish, while we are concerned with making towel weight (25-30 lbs/3000 sq. ft. ream) from recycle fiber, which may mask the underlying Yankee from the IR thermometer more effectively than in U.S. Pat. No. 5,494,554. It should also be noted that we are making our measurements in the falling rate portion of the drying curve in which the rate of loss of moisture is slowed.

The pulp can be mixed with strength adjusting agents, such as wet strength agents, dry strength agents and debonders/softeners, and so forth. Suitable wet strength agents are known to the skilled artisan. A comprehensive, but non-exhaustive, list of useful strength aids include urea formaldehyde resins, melamine formaldehyde resins, glyoxylated polyacrylamide resins, polyamide-epichlorohydrin resins, and the like. Thermosetting polyacrylamides are produced by reacting acrylamide with diallyl dimethyl ammonium chloride (DADMAC) to produce a cationic polyacrylamide copolymer, which is ultimately reacted with glyoxal to produce a cationic cross-linking wet strength resin, glyoxylated polyacrylamide. These materials are generally described in U.S. Pat. No. 3,556,932 to Coscia et al. and U.S. Pat. No. 3,556,933 to Williams et al., both of which are incorporated herein by reference in their entirety. Resins of this type are commercially available under the trade name of PAREZ 631 NC by Bayer Corporation. Different mole ratios of acrylamide/DADMAC/glyoxal can be used to produce cross-linking resins, which are useful as wet strength agents. Furthermore, other dialdehydes can be substituted for glyoxal to produce thermosetting wet strength characteristics. Of particular utility are the polyamide-epichlorohydrin wet strength resins, an example of which is sold under the trade names Kymene 557LX and Kymene 557H by Hercules Incorporated of Wilmington, Del., and Amres® from Georgia-Pacific Resins, Inc. These resins and the process for making the resins are described in U.S. Pat. Nos. 3,700,623 and 3,772,076, each of which is incorporated herein by reference in its entirety. An extensive description of polymeric-epihalohydrin resins is given in Chapter 2: Alkaline Curing Polymeric Amine-Epichlorohydrin by Espy in Wet Strength Resins and Their Application (L. Chan, Editor, 1994), herein incorporated by reference in its entirety. A reasonably comprehensive list of wet strength resins is described by Westfelt in Cellulose Chemistry and Technology Volume 13, page 813, 1979, which is incorporated herein by reference.

Suitable temporary wet strength agents may likewise be included, particularly, in special applications where disposable towel with a permanent wet strength resin is to be avoided. A comprehensive, but non-exhaustive, list of useful temporary wet strength agents includes aliphatic and aromatic aldehydes including glyoxal, malonic dialdehyde, succinic dialdehyde, glutaraldehyde and dialdehyde starches, as well as substituted or reacted starches, disaccharides, polysaccharides, chitosan, or other reacted polymeric reaction products of monomers or polymers having aldehyde groups, and optionally, nitrogen groups. Representative nitrogen containing polymers, which can suitably be reacted with the aldehyde containing monomers or polymers, includes vinyl-amides, acrylamides and related nitrogen containing polymers. These polymers impart a positive charge to the aldehyde containing reaction product. In addition, other commercially available temporary wet strength agents, such as PAREZ 745, manufactured by Bayer, can be used, along with those disclosed, for example, in U.S. Pat. No. 4,605,702.

The temporary wet strength resin may be any one of a variety of water-soluble organic polymers comprising aldehydic units and cationic units used to increase dry and wet tensile strength of a paper product. Such resins are described in U.S. Pat. Nos. 4,675,394; 5,240,562; 5,138,002; 5,085,736; 4,981,557; 5,008,344; 4,603,176; 4,983,748; 4,866,151; 4,804,769 and 5,217,576. Modified starches sold under the trademarks CO-BOND® 1000 and COBOND®1000 Plus, by National Starch and Chemical Company of Bridgewater, N.J., may be used. Prior to use, the cationic aldehydic water soluble polymer can be prepared by preheating an aqueous slurry of approximately 5% solids maintained at a temperature of approximately 240° F. (116° C.) and a pH of about 2.7 for approximately 3.5 minutes. Finally, the slurry can be quenched and diluted by adding water to produce a mixture of approximately 1.0% solids at less than about 130° F. (54° C.).

Other temporary wet strength agents, also available from National Starch and Chemical Company are sold under the trademarks CO-BOND® 1600 and CO-BOND® 2300. These starches are supplied as aqueous colloidal dispersions and do not require preheating prior to use.

Temporary wet strength agents, such as glyoxylated polyacrylamide, can be used. Temporary wet strength agents such glyoxylated polyacrylamide resins are produced by reacting acrylamide with diallyl dimethyl ammonium chloride (DADMAC) to produce a cationic polyacrylamide copolymer, which is ultimately reacted with glyoxal to produce a cationic cross-linking temporary or semi-permanent wet strength resin, glyoxylated polyacrylamide. These materials are generally described in U.S. Pat. No. 3,556,932 to Coscia et al. and U.S. Pat. No. 3,556,933 to Williams et al., both of which are incorporated herein by reference. Resins of this type are commercially available under the trade name of PAREZ 631 NC, by Bayer Industries. Different mole ratios of acrylamide/DADMAC/glyoxal can be used to produce cross-linking resins, which are useful as wet strength agents. Furthermore, other dialdehydes can be substituted for glyoxal to produce wet strength characteristics.

Suitable dry strength agents include starch, guar gum, polyacrylamides, carboxymethyl cellulose, and the like. Of particular utility is carboxymethyl cellulose, an example of which is sold under the trade name Hercules CMC, by Hercules Incorporated of Wilmington, Del. According to one embodiment, the pulp may contain from about 0 to about 15 lb/ton (0 to 7.5 kg/tonne) of dry strength agent. According to another embodiment, the pulp may contain from about 1 to about 5 lbs/ton (0.5 to 2.5 kg/tonne) of dry strength agent.

Suitable debonders are likewise known to the skilled artisan. Debonders or softeners may also be incorporated into the pulp or sprayed upon the web after its formation. The present invention may also be used with softener materials including, but not limited to, the class of amido amine salts derived from partially acid neutralized amines. Such materials are disclosed in U.S. Pat. No. 4,720,383. Evans, Chemistry and Industry, 5 Jul. 1969, pp. 893-903; Egan, J. Am. Oil Chemist's Soc., Vol. 55 (1978), pp. 118-121; and Trivedi et al., J. Am. Oil Chemist's Soc., June 1981, pp. 754-756, incorporated by reference in their entirety, indicate that softeners are often available commercially only as complex mixtures rather than as single compounds. While the following discussion will focus on the predominant species, it should be understood that commercially available mixtures would generally be used in practice.

In many cases, a suitable softener material may be derived by alkylating a condensation product of oleic acid and diethylenetriamine. Synthesis conditions using a deficiency of alkylation agent (e.g., diethyl sulfate) and only one alkylating step, followed by pH adjustment to protonate the non-ethylated species, result in a mixture consisting of cationic ethylated and cationic non-ethylated species. A minor proportion (e.g., about 10%) of the resulting amido amine cyclize to imidazoline compounds. Since only the imidazoline portions of these materials are quaternary ammonium compounds, the compositions as a whole are pH-sensitive. Therefore, in the practice of the present invention with this class of chemicals, the pH in the head box should be approximately 6 to 8, more preferably, 6 to 7 and most preferably, 6.5 to 7.

Quaternary ammonium compounds, such as dialkyl dimethyl quaternary ammonium salts are also suitable, particularly when the alkyl groups contain from about 10 to 24 carbon atoms. These compounds have the advantage of being relatively insensitive to pH.

Biodegradable softeners can be utilized. Representative biodegradable cationic softeners/debonders are disclosed in U.S. Pat. Nos. 5,312,522; 5,415,737; 5,262,007; 5,264,082; and 5,223,096, all of which are incorporated herein by reference in their entirety. The compounds are biodegradable diesters of quaternary ammonia compounds, quaternized amine-esters, and biodegradable vegetable oil based esters functional with quaternary ammonium chloride and diester dierucyldimethyl ammonium chloride, which are representative biodegradable softeners.

In some embodiments, a particularly preferred debonder composition includes a quaternary amine component, as well as a nonionic surfactant.

In FIG. 1, biaxially undulatory cellulosic fibrous web 88 is characterized by a reticulum of intersecting crepe bars 92 and undulations defining ridges 90 on the air side thereof, crepe bars 92 extending transversely in the cross machine direction, ridges 90 extending longitudinally in the machine direction, web 88 having furrows 94 between ridges 90 on the air side, as well as crests 96 disposed on the Yankee side of the web opposite furrows 94 and sulcations 98 interspersed between crests 96 and opposite to ridges 90, wherein the spatial frequency of the transversely extending crepe bars 92 is from about 10 to about 150 crepe bars per inch (about 4 to about 60 crepe bars per cm), and the spatial frequency of the longitudinally extending ridges 90 is from about 10 to about 50 ridges per inch (about 4 to about 20 ridges per cm).

Figure 2:
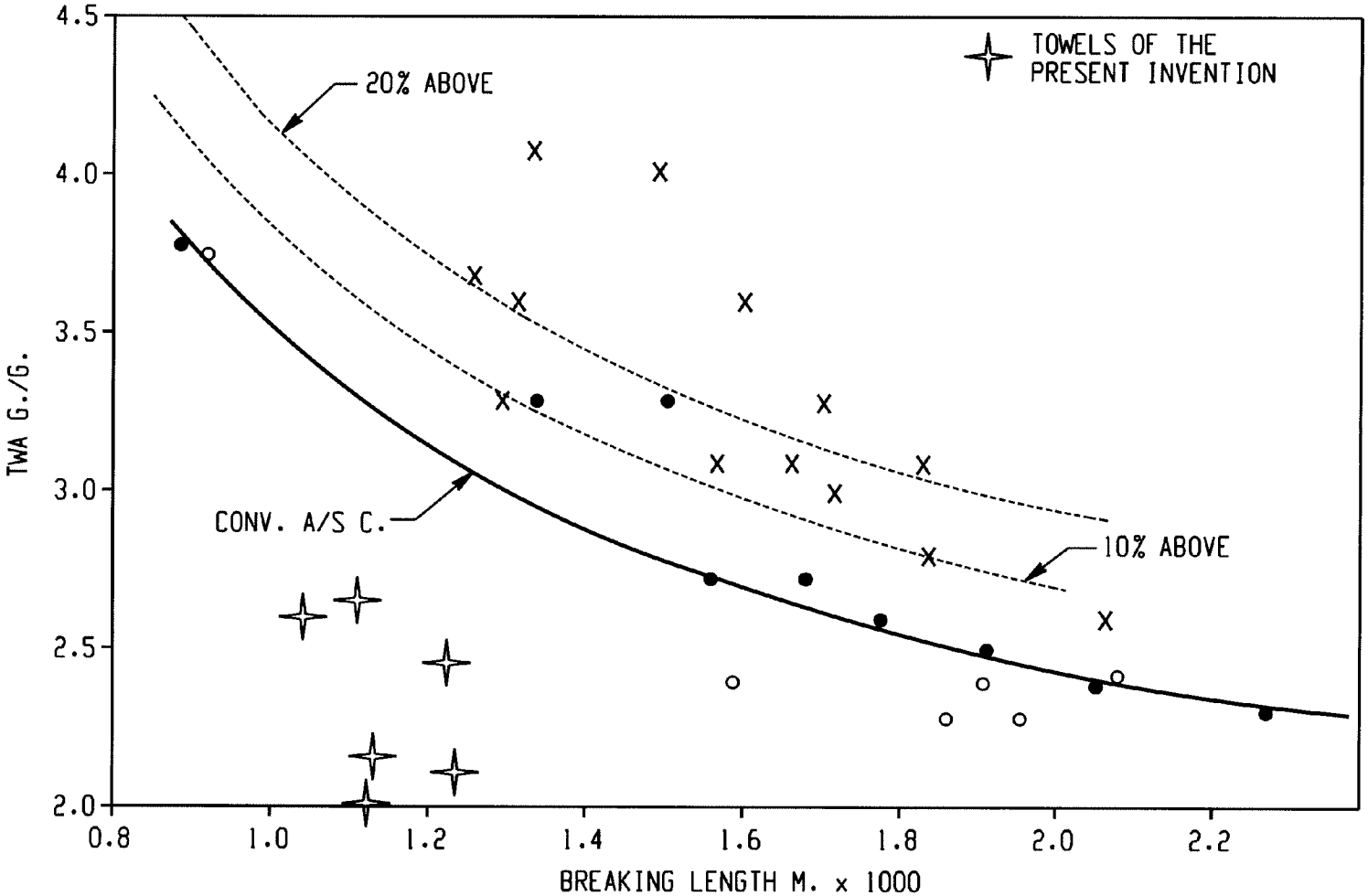
FIG. 2 illustrates the performance of toweling made from recycled fiber according to the present invention, in comparison to the performance of toweling made from virgin furnish by a wet crepe process known in the prior art.

FIG. 2 is a reproduction of FIG. 2 from U.S. Pat. No. 4,992,140, illustrating the performance reported in the prior art of wet creped webs made from virgin furnish. Superposed over this data are the results of Examples of the present invention represented by stars, as well as the result of a comparative example illustrating the performance of a commercial grade of wet creped toweling, represented by x's, also made from recycled furnish. It can be appreciated that, while the toweling of the present invention does not quite equal the absorbency of the most absorbent toweling made from virgin furnish, the absorbencies are comparable while the strengths are somewhat lower. In many cases, this is highly desirable, as it can be somewhat difficult to obtain low strength with wet creped webs, particularly, those made from recycle furnishes. Accordingly, these webs with excessive strength are usually considered low in softness and are not always considered suitable for the environments in which better toweling is expected, like professional offices and better restaurants. It should also be understood that the TWA method used to measure absorbency in U.S. Pat. No. 4,992,140 is not precisely translatable into the SAT method used herein, but the two methods are not so diverse that numerical comparisons between the two are not at least qualitatively useful. It should be noted that U.S. Pat. No. 4,992,140 apparently considers higher strength to be desirable in toweling, while our experience indicates that users prefer the increased softness resulting from lower strength towels, at least in the range of concern in this specification. In general, our experience is that it is fairly difficult to decrease the strength of wet creped towels into the optimum range. Accordingly, we prefer to form a weaker sheet in terms of dry tensile strength, then add sufficient temporary wet strength resin to bring the cross-machine directional or CD wet tensile up to the desired level, while most of retaining the benefits of increased softness and absorbency flowing from the use of a lower strength sheet. We prefer a CD wet tensile of at least about 650 g/3", preferably, about 700 g/3", still more preferably, about 750 g/" and most preferably, about 800 g/3".

Figure 3:
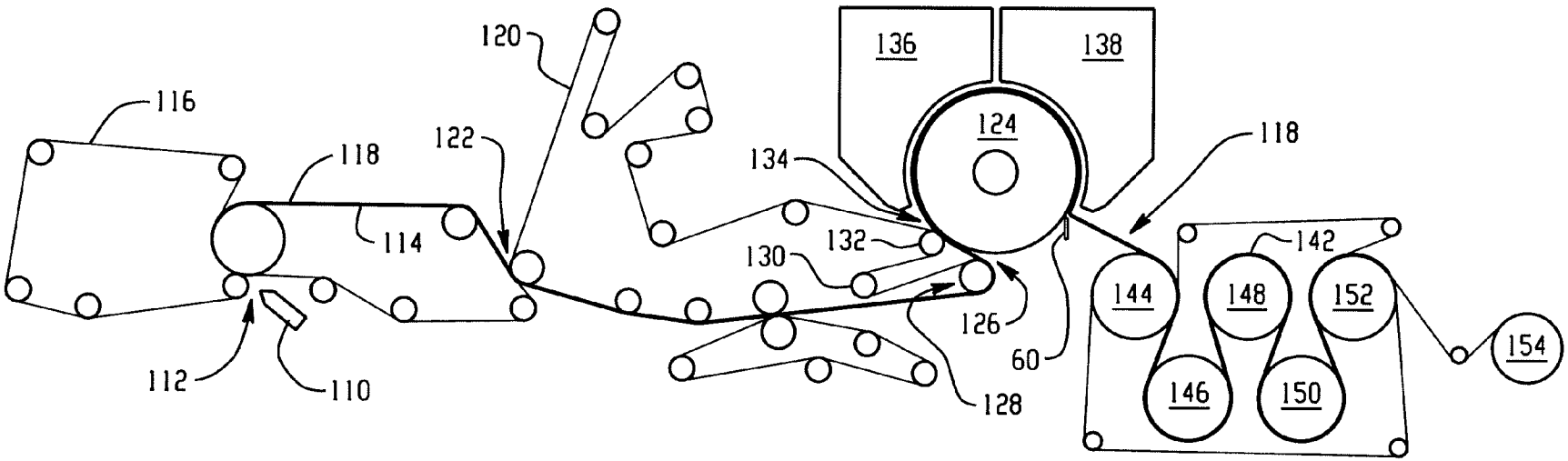
FIG. 3 illustrates a machine layout suitable for production of toweling according to the process of the present invention.

FIG. 3 is a schematic of a known twin wire wet crepe machine layout that can readily be adapted to practice the present invention. Furnish issues from headbox 110 into nip 112 between inner wire 114 and outer wire 116 forming nascent web 118 carried on inner wire 114 and transferred to felt 120, passing though nip 122 before being adhered to Yankee 124 as it passes through nip 126 between suction pressure roll 128 and Yankee 124. We prefer to maintain the pressure in nip 126 between suction pressure roll 128 and Yankee 124 at a level of about 1200 psi corresponding to a calculated line loading of about 600 pli, while maintaining the vacuum level in suction pressure roll 128 at between 5 to 10 inches of mercury. In a configuration known in the prior art, felt 120 passes over idler roll 130 before passing around blind drilled roll 132 and though nip 134 between blind drilled roll 132 and Yankee 124. As nascent web 118 is conveyed around Yankee 124, hot air from wet end hood 136 and dry end hood 138 is directed against nascent web 118 augmenting the drying effect of steam condensing inside Yankee 124. In the practice of the invention, the Yankee parameters, including Yankee speed, internal steam pressure, the hood velocities and temperatures, are carefully monitored to ensure that nascent web 118 has a moisture content estimated at about 6% to about 9% as it encounters undulatory creping blade 60. As measurement of the exact level of sheet moisture is subject to numerous uncertainties, in this range of the falling rate portion of the drying curve, we control sheet temperature of web 118 as measured just prior to crepe blade 60 to between 225° F. and 255° F. (107° C. to 124° C.), preferably, ranging from about 230° F. (110° C.) to about 250° F. (121° C.), more preferably, from about 235° F. (113° C.) to about 245° F. (118° C.). Typically, nip 134 between blind drilled roll 132 and Yankee 124 will be unloaded during the practice of the present invention, although in some of the Examples herein, nip 134 was loaded as indicated. In our experience, the compaction history of web 118 as it is applied to Yankee 124 is critical in that if too much compaction is applied to the web, the tensile strength of the dried web becomes excessive, leading both to loss of absorbency and softness.

We have found that we can correlate the absorbency of web 118 closely with the creping temperature and the geometric mean breaking length of web 118, which is, in turn, strongly influenced by the pressure or pressures applied to web 118 as it is adhered to and passes around Yankee 124. If the degree of compaction is such that the geometric mean breaking length of web 118 exceeds about 1350 meters, we find that absorbency suffers greatly. In particular, we control the geometric mean breaking length of web 118 to between about 1000 and 1300 meters by controlling the level of compaction applied to web 118 along with the amount and type of wet strength agents refining applied to the furnish. Preferably, the geometric mean breaking length of web 118 after it is dried ranges from about 1050 meters up to about 1250 meters with a particular "sweet spot" ranging from about 1100 meters and about 1250 meters. By controlling geometric mean breaking length and sheet temperature to fall with the ranges described while using a PVOH/epichlorohydrin cross-linked polyamide creping adhesive and an undulatory blade, we are able to obtain over 20% improvement in specific SAT absorbency as compared to an otherwise comparable wet creping process. By way of comparison, a competitive wet creped brown towel exhibits a GM breaking length of 1393 meters and a specific SAT absorbency of 2.14 g/g, while a competitive bleached or white towel exhibits a specific SAT of 1.82 g/g at a breaking length of 1802 meters.

After removal from Yankee 124, moist web 118 is preferably enveloped in sandwich 142 formed between two fabrics, so that residual moisture therein can be removed as sandwich 142 passes around internally heated cans 144, 146, 148, 150 and 152 before being wound onto reel 154. Often, a very large number of cans may be used; oftentimes, over a dozen or more cans will be used. It is not strictly necessary to envelope moist web 118 in a sandwich as it passes around the array of dryer cans. In some cases, the sheet itself may be unsupported as it passes around each can in the array, or the sheet may be carried on a single fabric and, therefore, contact alternate cans in configurations well known in the prior art.

Because we are able to decrease the dry strength more than is generally practicable with wet creping, we are able to increase the wet strength of the sheet, while still maintaining comparable softness to stronger wet creped products, enabling us to achieve increases in wet strength that are perceivable by the user at the same time as we achieve user perceptible increases in absorbency.

The creping adhesive used in the present invention comprises an aqueous admixture of polyvinyl alcohol and a polyamide crosslinked with an epihalohydrin, such as epichlorohydrin. Suitable creping adhesives comprise an aqueous solution of polyvinyl alcohol, and a thermosetting cationic polyamide resin. In the practice of this invention, we carefully monitor sheet temperature prior to creping, to ensure that sufficient moisture remains in the sheet at the time of creping, to obviate the need for a plasticizer that would otherwise typically be used in the case of dry creping. The creping adhesive is typically applied as a solution containing from about 0.1 to about 1 percent solids, the balance being water. The suitable thermosetting cationic polyamide resins are the water-soluble polymeric reaction product of an epihalohydrin, preferably, epichlorohydrin, and a water-soluble polyamide having secondary amine groups derived from polyalkylene polyamine and a saturated aliphatic dibasic carboxylic acid containing from about 3 to 10 carbon atoms. The amount of polyvinyl alcohol can be from about 1 to about 80 weight percent, more specifically, from about 20 to about 60 weight percent on a solids basis. The water soluble polyamide contains recurring groups of the formula:

—NH(C"H2*n*HN)*x*-CORCO— where n and x are each 2 or more and R is the divalent hydrocarbon radical of the dibasic carboxylic acid. An important characteristic of these resins is that they are phase compatible with polyvinyl alcohol. Suitable materials of this type are commercially available under the trademarks KYMENE® (Hercules, Inc.) and CASCAMID® (Borden) and are more fully described in U.S. Pat. No. 2,926,116 issued to Gerald Keim on Feb. 23, 1960, U.S. Pat. No. 3,058,873 issued to Gerald Keim et al. on Oct. 16, 1962, and U.S. Pat. No. 4,528,316 issued to Dave Soerens on Jul. 9, 1985, all of which are herein incorporated by reference. The creping adhesive includes polyvinyl alcohol. The amount of the thermosetting cationic polyamide resin in the creping composition, on a solids weight percent basis, can be from about 10 to about 80 percent, more specifically, from about 20 to about 60 percent. Suitable plasticizers include quaternized polyamino amides and sorbitol, although the plasticizing mechanism of sorbitol is likely different than that of the quaternized polyamino amides. A significant amount of this moisture is desirably included in the sheet to plasticize adhesive as it hits the crepe blade, in order to reduce the risk that the tissue sheet will wrap around the dryer, and to prevent substantial build up of fibers on the dryer surface. Suitable amounts of water are retained in the creping adhesive composition when the sheet temperature at the crepe blade is from about 230° F. (110° C.) to about 250° F. (121° C.). More preferably, the sheet temperature is controlled to from about 235° F. (113° C.) to about 245° F. (118° C.).

Figure 6:
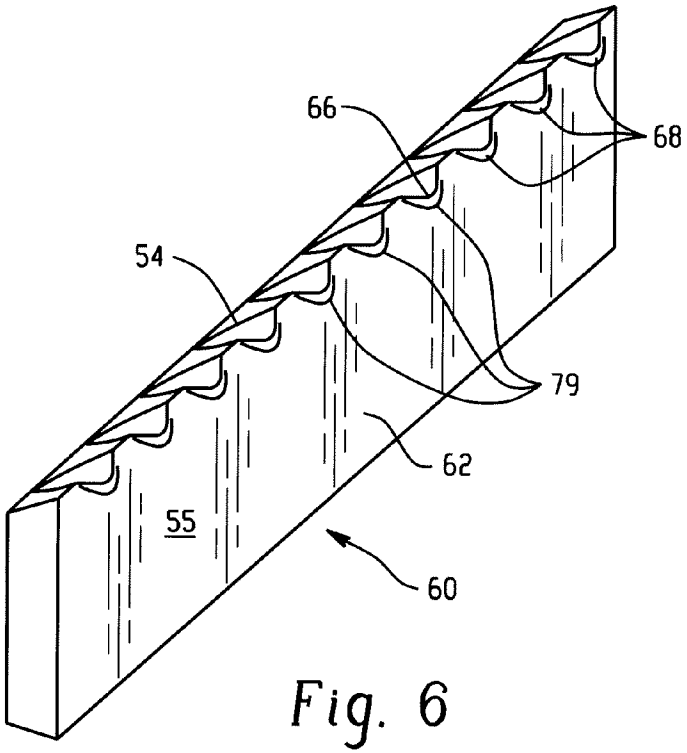
Fig. 6 PRIOR ART
FIGS. 4, 5, 6 and 7 illustrate one variety of undulatory creping blade suitable for producing toweling according to the present invention.
Figure 4:
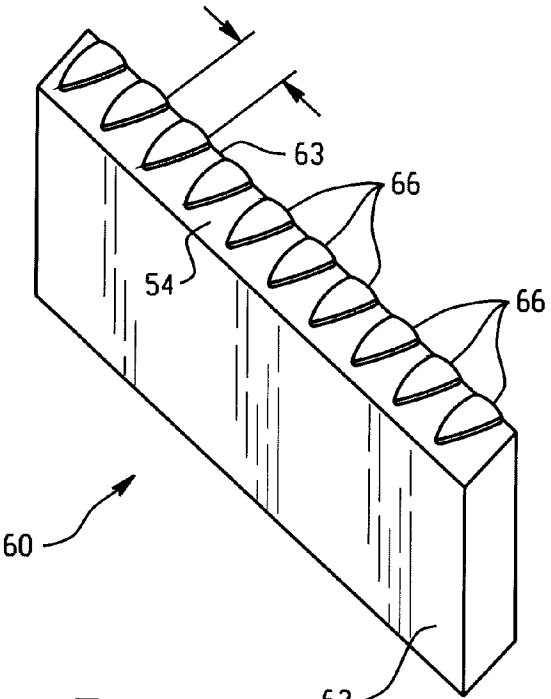
Fig. 4 PRIOR ART

FIGS. 4 and 6 illustrate a portion of a preferred undulatory creping blade 60 usable in the practice of the present invention, in which body 62 extends indefinitely in length, typically, exceeding 100 inches (254 cm) in length and often reaching over 26 feet (366 cm) in length to correspond to the width of the Yankee dryer on the larger modern paper machines. Flexible blades of the patented undulatory blade having indefinite length can suitably be placed on a spool and used on machines employing a continuous creping system. In such cases, the blade length would be several times the width of the Yankee dryer. In contrast, the width of body 62 of blade 60 is usually on the order of several inches, while the thickness of body 62 is usually on the order of fractions of an inch.

Figure 7:
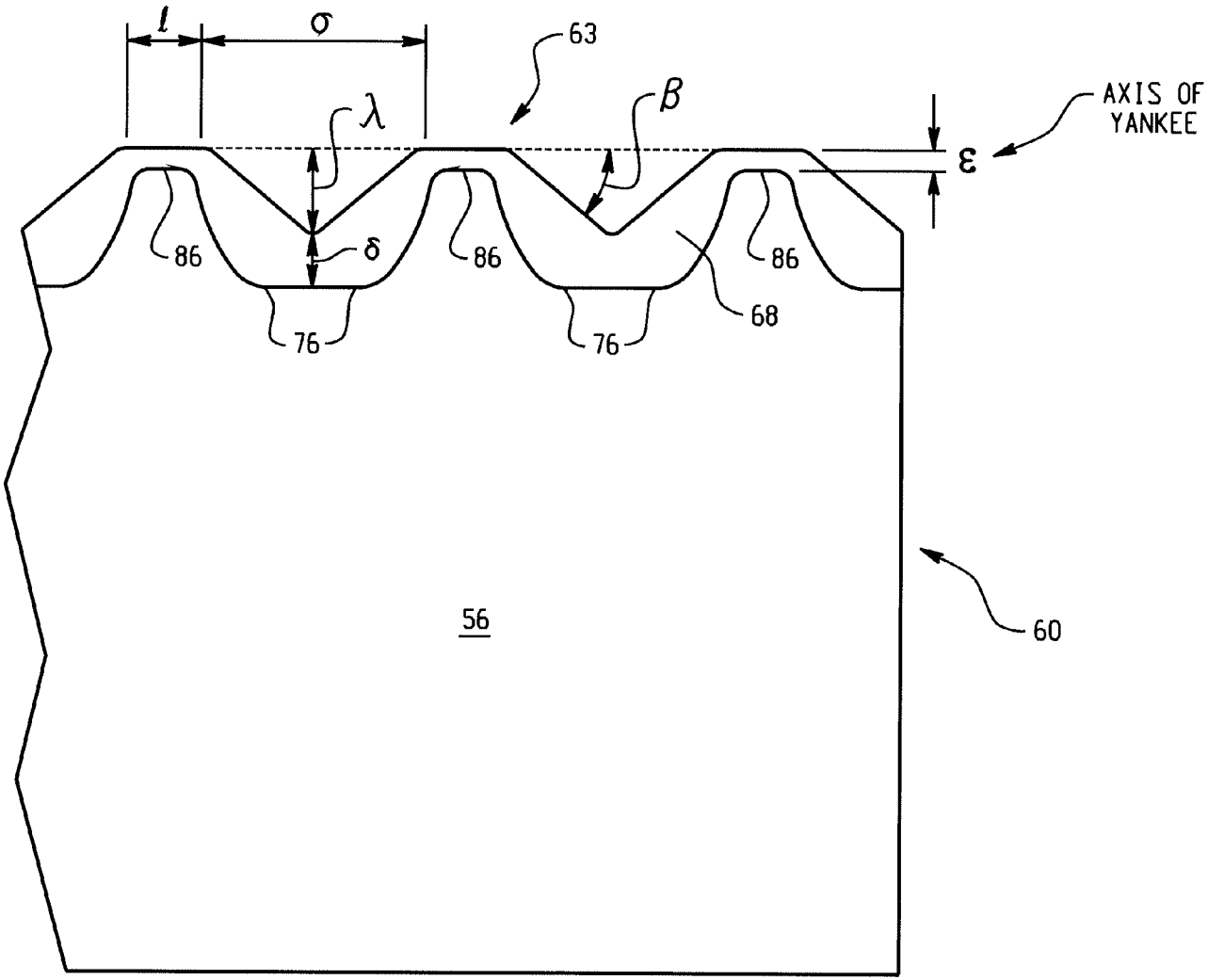
Fig. 7 PRIOR ART
Figure 8:
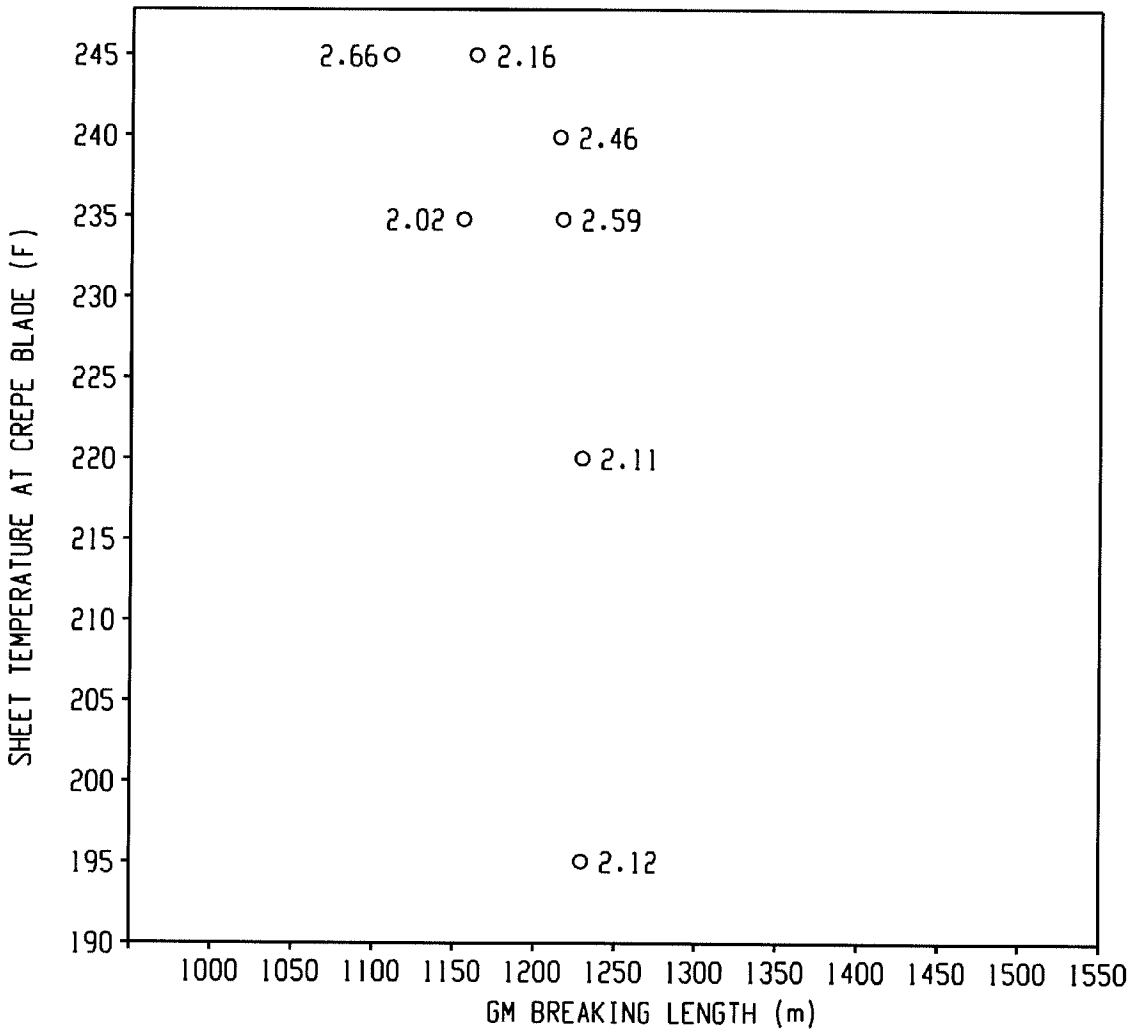
FIG. 8 illustrates the specific absorbency (SAT) of towels of the present invention on a graph of breaking length and sheet temperature.

As illustrated in FIGS. 4 and 6, an undulatory cutting edge 63 is defined by serrulations 66 disposed along, and formed in, one edge of the body 62, so that undulatory engagement surface 68, schematically illustrated in more detail in FIG. 7, disposed between rake surface 54 and relief surface 56, engages Yankee 124 (FIG. 3) during use.

Figure 5:
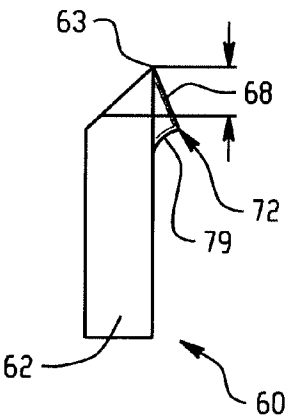
Fig. 5 PRIOR ART

When the most preferred undulatory creping blades of the patented undulatory blade are formed as shown in FIGS. 4, 5, and 6, and as shown in detail in FIG. 7, each serrulation 66 results in the formation of indented undulatory rake surfaces 54, nearly planar crescent-shaped bands 76, as shown in FIG. 7, foot 72, and protruding relief surface 79, as shown in FIG. 5. As illustrated best in FIG. 7, the undulatory engagement surface 68 consists of a plurality of substantially co-linear rectilinear elongate regions 86 of width C, and length "l" interconnected by nearly planar crescent-shaped bands 76 of width $\delta$, depth $\lambda$, and span $\sigma$. As seen best in FIGS. 4 and 6, each nearly planar crescent-shaped band 76 (shown in FIG. 7) defines one surface of each relieved foot 72 projecting out of relief surface 56 of body 62 of blade 60. We have found that, for best results, certain of the dimensions of the respective elements defining undulatory engagement surface 68, i.e., substantially co-linear rectilinear elongate regions 86 and nearly planar crescent-shaped bands 76, both shown in FIG. 7, are preferred. In particular, as shown in FIG. 7, width $\epsilon$ of substantially co-linear rectilinear elongate regions 86 is preferably substantially less than width $\delta$ of nearly planar crescent-shaped bands 76, at least in a new blade. In preferred embodiments of undulatory blade 60 used to manufacture absorbent paper products of this invention, length "l" of substantially co-linear rectilinear elongate regions 86 should be from about 0.015" (0.381 mm) to about 0.040" (1.016 mm). For most applications, "l" will be less than 0.035" (0.889 mm). Depth $\lambda$ of the serrulations 66 in undulatory blade 60 should be from about 0.015" (0.381 mm) to about 0.035" (0.889 mm); more preferably, from about 0.020" (0.508 mm) to about 0.030" (0.762 mm) and most preferably, from about 0.025" (0.635 mm) to about 0.030" (0.762 mm), and span "$\sigma$" of nearly planar crescent-shaped bands 76 should be from about 0.030" (0.762 mm) to about 0.060" (1.524 mm); more preferably, from about 0.035" (0.889 mm) to about 0.055" (1.397 mm) and, most preferably, from about 0.045" (1.143 mm) to about 0.055" (1.397 mm). The undulatory blade used in the Examples reported herein had 10-12 teeth per inch (4-5 teeth per cm) at about 0.030" (0.762 mm) depth with a 75 degree facing angle, and 14 degree dress angle.

Figure 9:
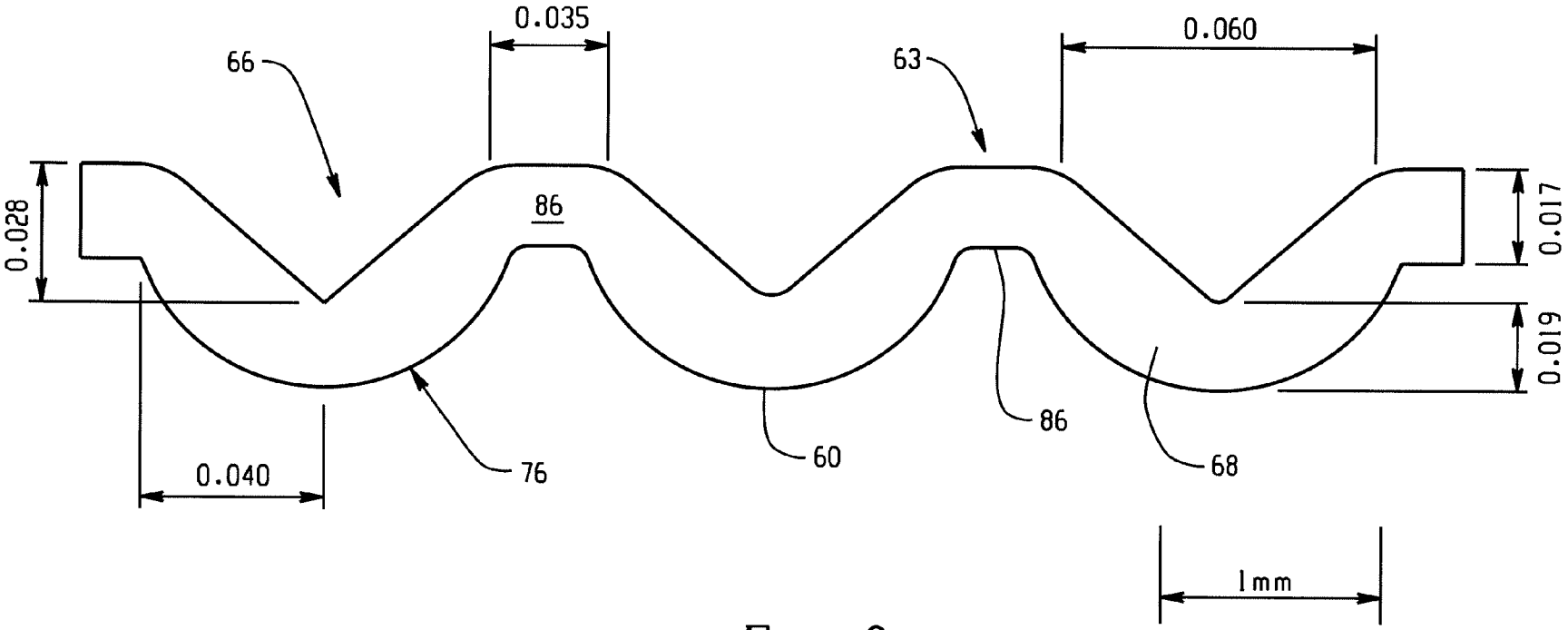
FIG. 9 illustrates the preferred undulatory creping blade suitable for producing toweling according to the present invention.

FIG. 9 is a tracing of a photomicrograph of the preferred undulatory blade for use in the present invention having 11 teeth per inch in which: length "l" of substantially co-linear rectilinear elongate regions 86 is about 0.035" (0.889 mm); width "ϵ" of substantially co-linear rectilinear elongate regions 86 is about 0.017" (0.432 mm); depth "λ" of the serrulations 66 is about 0.028" (0.711 mm), while width "δ" of nearly planar crescent-shaped bands 76 is about 0.019" (0.483 mm) and span "σ" of nearly planar crescent-shaped bands 76 is about 0.040" (1.016 mm). In preferred embodiments of undulatory blade 60 used to manufacture absorbent paper products of this invention, width "ϵ" of substantially co-linear rectilinear elongate regions 86 is from about 0.015" (0.381 mm) to about 0.020" (0.508 mm), length "l" of substantially co-linear rectilinear elongate regions 86 is from about 0.030" (0.762 mm) to about 0.040" (1.016 mm). Depth "λ" of the serrulations 66 in undulatory blade 60 is from about 0.025" (0.635 mm) to about 0.035" (0.889 mm); and span "σ" of nearly planar crescent-shaped bands 76 is from about 0.035" (0.889 mm) to about 0.045" (1.143 mm), while depth "δ" is from about 0.015" (0.381 mm) to about 0.025" (0.635 mm).

EXAMPLES

Examples 1-7

Bleached and un-bleached toweling base sheet was manufactured on a commercial scale machine having the layout shown in FIG. 3 using a Yankee chemical package including: PVOH 5222 (a proprietary mixture of 97%+ vinyl alcohol polymers, with minor amounts of methanol, sodium acetate, and other process aids); PAL Ultra Crepe HT 770 epoxidized polyamide creping adhesive, and Hercules 4609 quaternary ammonium salt mixture in the production run. Initial add-on rates of 460 ml/min for PVOH 5222, 45 ml/min for PAL Ultra Crepe HT, and, as a release agent, 15 ml/min for Hercules 4609 were used with a essentially no reel crepe w (−1%). Buckman 385 absorbency aid, which is believed to be a proprietary combination of surfactants, was used to improve the water absorbency rate during the run at an initial add-on rate of 110 ml/min (~2 #/T). Table 1 lists the chemicals used during the run and their addition points. Parez 631 dry strength agents or Varisoft GP-C debonder were added as needed to achieve dry strength targets. The blind drilled roll was loaded or unloaded for the production run as indicated in Tables 3 and 3C. The code PA indicates the use of prior art creping adhesive in Example 3C while the code PVOH/PA indicates the use of polyvinyl alcohol/epichlorohydrin crosslinked polyamide creping adhesive as discussed above. The base sheet properties of examples of the present invention are indicated in Table 3B.

PM Run Procedures

Un-Bleached Base Sheet

The furnish blends indicated in Table 2 were used targeting a basis weight of 29 #/rm using an undulatory crepe blade. To control the sheet moisture to fall in the range of from 6 to 9% at the crepe blade, the Yankee steam pressure was increased to 70 psi and the hood temperature to 780° F., while maintaining reel moisture at less than 3%. Buckman 385 absorbency aid was added as needed to achieve the WAR target of 30 sec. Similarly, wet strength resin as added to achieve the wet tensile strength target of 950 g/3". Dry strength targets as listed in Table 2 were achieved by adding either Parez 631 or Varisoft de-bonder as needed. Comp U and Comp BL are competitive products offered in the market believed to be made from recycle fiber using a wet crepe process.

Bleached Base Sheet

The furnish blend consists of 40% SFK PCW (post consumer waste) fiber, 32% SW BCTMP and 28% Peace River SWK. The basis weight was targeted at 27 #/rm using an undulatory blade (10 tpi/0.035" depth). Yankee steam pressure was increased to 70 psi and the hood temperature to 780° F., while Yankee speed was cut as needed to control sheet moisture at the crepe blade to fall in the 6-9% range, while maintaining reel moisture at less than 3%. Buckman 385 absorbency aid was added to achieve the WAR target of 20 sec. The amount of wet strength resin was controlled to achieve wet tensile strength target as set forth in Table 2, while either Parez 631 or Varisoft GP-C debonder were added as needed to achieve the dry strength targets.

TABLE 1

Wet-end Chemicals

| Chemical Description | Brand Name | Purpose | Addition Point |
|---|---|---|---|
| Wet Strength Resin | Amres | Improve wet tensile strength | Suction side of the machine chest pump |
| Absorbency Aid | Buckman 385 | Improved water absorbency rate | Saveall Chest |
| Dry Strength Resin | Parez 631 wsr; or Varisoft GPCC debonder | dry strength or debonder as needed | Down leg of stuff box |

TABLE 2

Specifications of Base Sheets

| Base Sheet | Un-Bleached | Bleached |
|---|---|---|
| Basis Wt | 29 (28.0-30.0) | 27 (26.0-28.0) |
| Caliper | 67 (59-75) | 67 (59-75) |
| MD Dry Ten | 5500 (4300-6800) | 5100 (3900-6400) |
| CD Dry Ten | 3500 (2500-4500) | 3150 (2150-4150) |
| MD/CD Ratio | 1.5 | 1.6 |
| CD Wet Ten | 950 (700 min.) | 950 (700 min.) |
| MD Stretch | 8% (5%-10%) | 8% (5%-10%) |
| WAR (sec) | 30 | 20 |
| Furnish | 100% recycle containing at least 40% PCW | 40% Light House SFK PCW 32% SW BCTMP 28% Peace River SWK |
| Crepe Blade | Undulatory 12 tpi/0.030" (0.762 mm) depth | Undulatory 12 tpi/0.030" (0.762 mm) depth |

TABLE 3

| Finished Product Properties | | | | | | | | |
|---|---|---|---|---|---|---|---|---|
| Example # | 1 Bl. | 2 Bl. | 2A Bl. | 3C Unbl. | 4 Unbl. | 5 Unbl. | 6 Unbl. | 7 Unbl. |
| WSR | 16.0 | 16.0 | 17.7 | 5.4 | 8.0 | 7.8 | 6.4 | 7.4 |
| DSR | 2.5 | 6.7 | 2.9 | 0.0 | 0.0 | 0.0 | 1.6 | 1.8 |
| Absorbency Aid | 6.7 | 7.2 | 7.4 | 0.0 | 6.0 | 4.8 | 4.3 | 5.6 |
| BDR Load | 1200 | 0 | 0 | 1200 | 1200 | 0 | 1200 | 0 |
| Yankee Speed | 2360 | 2250 | 2276 | 2525 | 2400 | 2000 | 2400 | 2060 |
| Reel Speed | 2243 | 2137 | 2157 | 2384 | 2279 | 1908 | 2290 | 1965 |
| % Reel Crepe | 5.3 | 5.3 | 5.5 | 0.0 | −0.3 | −0.7 | −0.7 | −0.7 |
| Hood Temp (° F.) | 800 | 800 | 750 | 645 | 800 | 800 | 750 | 770 |
| Yankee Steam (psi) | 68 | 90 | 98 | 46 | 70 | 70 | 65 | 70 |
| Reel Moisture (%) | 1.8 | 2.0 | 2.0 | 4.0 | 1.8 | 2.1 | 1.7 | 1.9 |
| Yankee Coat | PVOH/ PA | PVOH/ PA | PVOH/ PA | PA | PVOH/ PA | PVOH/ PA | PVOH/ PA | PVOH/ PA |
| Crepe Moisture (%) | | 5.0 | | | 8.5 | | | |
| Crepe Temp (° F./° C.) | 235/113 | 240/116 | 230/110 | 195/91 | 220/104 | 235/113 | 245/118 | 245/118 |
| BW (lbs/rm) | 26.5 | 25.9 | 26.5 | 29.5 | 29.2 | 29.3 | 26.7 | 27.8 |
| Caliper (mils/8 sheets) | 60 | 56 | 53 | 43 | 51 | 55 | 51 | 52 |
| Dry MD Tensile (g/3") | 4653 | 4955 | 5301 | 6607 | 5746 | 5115 | 4864 | 4733 |
| Dry CD Tensile (g/3") | 3207 | 3465 | 3404 | 5041 | 3455 | 3044 | 3167 | 3397 |
| MD Stretch (%) | 9.3 | 8.8 | 8.8 | 6.67 | 7.1 | 6.7 | 7.1 | 6.8 |
| CD Stretch (%) | 4.4 | 4.6 | 4.9 | 3.9 | 3.5 | 3.8 | 3.3 | 3.6 |
| Wet MDT | 1209 | 1292 | 1624 | 1024 | 1749 | 1074 | 1057 | 1165 |
| Wet CDT | 759 | 862 | 1007 | 803 | 1081 | 879 | 939 | 946 |
| WAR (seconds) | 55 | 36 | 37 | 58 | 42 | 33 | 53 | 37 |
| SAT Capacity (g/m$^2$) | 83 | 98 | 102 | 101.8 | 100.2 | 130.5 | 106 | 131.1 |
| SAT (gw/gf) | 1.91 | 2.33 | 2.36 | 2.12 | 2.11 | 2.74 | 2.44 | 2.90 |
| SAT Time (seconds) | 318 | 329 | 1613 | 422 | 346.8 | 475 | 518 | 633 |
| SAT Rate (g/sec $^{0.5}$) | 0.007 | 0.010 | 1036 | 0.010 | 0.009 | 0. 015 | 0.011 | 0.014 |
| GM Break Modulus | 606 | 651 | 646 | 1128 | 893 | 792 | 813 | 808 |
| Overhang length MD (Yankee Up, cm) | 7.0 | 7.9 | 10.1 | 8.9 | 7 | 7.7 | 6.6 | 7.0 |
| Overhang length MD (Yankee Down, cm) | 3.9 | 5.1 | 5.9 | 7.6 | 5.8 | 6.4 | 5.4 | 6.2 |
| Bending Length MD (Yankee Down, cm) | 1.9 | 2.5 | 2.9 | 3.8 | 2.9 | 3.2 | 2.7 | 3.1 |
| Bending Length MD (Yankee UP, cm) | 3.5 | 3.9 | 5.0 | 4.5 | 3.6 | 3.9 | 3.3 | 3.5 |
| Bending Length MD (cm) | 2.7 | 3.2 | 4.0 | 4.1 | 3.3 | 3.5 | 3.0 | 3.3 |
| TMI Friction | 0.677 | 0.661 | 0.632 | 0.416 | 0.545 | 0.598 | 0.647 | 0.621 |
| GM Breaking Length (m) | 1175 | 1292 | 1292 | 1576 | 1230 | 1086 | 1185 | 1163 |

TABLE 3B

| Base Sheet Properties | | | | | | | |
|---|---|---|---|---|---|---|---|
| Example # | 1 Bl. | 2 Bl. | 3 Unbl. | 4 Unbl. | 5 Unbl. | 6 Unbl. | 7 Unbl. |
| WSR | 16.0 | 16.0 | 5.4 | 8.0 | 7.8 | 6.4 | 7.4 |
| DSR | 2.5 | 6.7 | 0.0 | 0.0 | 0.0 | 1.6 | 1.8 |
| Absorbency Aid | 6.7 | 7.2 | 0.0 | 6.0 | 4.8 | 4.3 | 5.6 |
| BDR Load | 1200 | 0 | 1200 | 1200 | 0 | 1200 | 0 |
| Yankee Speed | 2360 | 2250 | 2525 | 2400 | 2000 | 2400 | 2060 |
| Reel Speed | 2243 | 2137 | 2384 | 2279 | 1908 | 2290 | 1965 |
| % Reel Crepe | 5.3 | 5.3 | 0.0 | −0.3 | −0.7 | −0.7 | −0.7 |
| Hood Temp (° F./° C.) | 800/427 | 800/427 | 645/341 | 800/427 | 800/427 | 750/399 | 770/410 |
| Yankee Steam (psi) | 68 | 90 | 46 | 70 | 70 | 65 | 70 |
| Reel Moisture (%) | 1.8 | 2.0 | 4.0 | 1.8 | 2.1 | 1.7 | 1.9 |
| Yankee Coat | PVOH/ PA | PVOH/ PA | PA | PVOH/ PA | PVOH/ PA | PVOH/ PA | PVOH/ PA |
| Crepe Moisture | | | | | | | |
| Crepe Temp (° F./° C.) | 235/113 | 240/116 | 195/91 | 220/104 | 235/113 | 245/118 | 245/118 |
| BW (lbs/rm) | 26.7 | 25.8 | | 29.2 | 29.9 | 27.5 | 28.4 |
| Caliper (mils/8 sheets) | 66 | 66 | | 51 | 67 | 61 | 63 |
| Dry MD Tensile (g/3") | 4638 | 4688 | | 5746 | 4926 | 4816 | 4613 |
| Dry CD Tensile (g/3") | 3154 | 3213 | | 3455 | 3011 | 3259 | 3299 |
| MD Stretch (%) | 10.1 | 9.8 | | 7.1 | 7.3 | 7.9 | 7.2 |
| CD Stretch (%) | 4.3 | 4.6 | | 3.5 | 3.8 | 3.5 | 3.6 |
| Wet MDT | 1399 | 1340 | | 1749 | 1464 | 1353 | 1395 |
| Wet CDT | 802 | 766 | | 1081 | 983 | 898 | 1108 |
| WAR (seconds) | 61 | 37 | | 42 | 38 | 57 | 37 |
| SAT Capacity (g/m$^2$) | 88 | 103 | | 100.2 | 126.1 | 97 | 122.8 |

TABLE 3B-continued

| Base Sheet Properties | | | | | | | |
|---|---|---|---|---|---|---|---|
| Example # | 1 Bl. | 2 Bl. | 3 Unbl. | 4 Unbl. | 5 Unbl. | 6 Unbl. | 7 Unbl. |
| SAT (gw/gf) | 2.02 | 2.46 | | 2.11 | 2.59 | 2.16 | 2.66 |
| SAT Time (seconds) | 354 | 314 | | 346.8 | 399 | 305 | 370 |
| SAT Rate (g/sec $^{0.5}$) | 0.007 | 0.010 | | 0.009 | 0.014 | 0.010 | 0.014 |
| GM Break Modulus | 606 | 651 | 1128 | 893 | 792 | 813 | 808 |
| GM Breaking Length (m) | 1155 | 1213 | | 1230 | 1038 | 1161 | 1107 |

TABLE 3C

| Finished Product Properties for Additional Samples | | | | | |
|---|---|---|---|---|---|
| Example # | 7D | 7E | Comp U | Comp Bl | 7F |
| WSR | 9.4 | 10.2 | | | 17.5 |
| DSR | 3.2 | 4.0 | | | 4.0 |
| Absorbency Aid | 7.4 | 7.5 | | | 7.5 |
| BDR Load | 0 | 0 | | | 0 |
| Yankee Speed | 2150 | 2150 | | | 2360 |
| Reel Speed | 2038 | 2037 | | | 2232 |
| % Reel Crepe | 5.5 | 5.5 | | | 5.8 |
| Hood Temp (° F.) | 750 | 767 | | | 770 |
| Yankee Steam (psi) | 95 | 95 | | | 90 |
| Reel Moisture (%) | 2.6 | 2.0 | | | 2.2 |
| Yankee Coat | PVOH/PA | PVOH/PA | | | PVOH/PA |
| Crepe Moisture (%) | | | | | |
| Crepe Temp (° F./° C.) | 230/110 | 230/110 | | | 220/104 |
| BW (lbs/rm) | 28.8 | 28.7 | 26.3 | 28.2 | 26.2 |
| Caliper (mils/8 sheets) | 57 | 58 | 45 | 49 | 51 |
| Dry MD Tensile (g/3") | 5714 | 5931 | 7909 | 8630 | 5225 |
| Dry CD Tensile (g/3") | 3690 | 3606 | 2611 | 4619 | 3227 |
| MD Stretch (%) | 7.7 | 8.1 | 8 | 8 | 9.3 |
| CD Stretch (%) | 4.1 | 4.5 | 4 | 4 | 5.1 |
| Wet MDT | 1723 | 1924 | 2096 | 1816 | 1798 |
| Wet CDT | 979 | 1200 | 664 | 1005 | 1004 |
| WAR (seconds) | 33 | 28 | 90.8 | 106.0 | 39 |
| SAT Capacity (g/m$^2$) | 116.5 | 118.4 | 91.7 | 83.5 | 111 |
| SAT (gw/gf) | 2.49 | 2.53 | 2.14 | 1.82 | 2.61 |
| SAT Time (seconds) | 375.3 | 286.5 | 416 | 374 | 566 |
| SAT Rate (g/sec $^{0.5}$) | 0.012 | 0.013 | 0.010 | 0.007 | 0.011 |
| GM Break Modulus | 814 | 762 | 758 | 1087 | 597 |
| Overhang length MD (Yankee Up, cm) | 8 | 9 | | | 7.9 |
| Overhang length MD (Yankee Down, cm) | 6.8 | 5.8 | | | 5.3 |
| Bending Length MD (Yankee Down, cm) | 3.4 | 2.9 | | | 2.7 |
| Bending Length MD (Yankee UP, cm) | 4.0 | 4.3 | | | 3.9 |
| Bending Length MD (cm) | 3.7 | 3.6 | 3.8 | 3.9 | 3.3 |

TABLE 3C-continued

| Finished Product Properties for Additional Samples | | | | | |
|---|---|---|---|---|---|
| Example # | 7D | 7E | Comp U | Comp Bl | 7F |
| TMI Friction | 0.596 | 0.530 | 0.706 | 1.152 | 0.653 |
| GM Breaking Length (m) | 1286 | 1299 | 1393 | 1802 | 1263 |

Example 8

Samples of toweling produced according to Examples 3C, 5 and 7 as well as competitive samples were subjected to consumer testing by the assignee of the present application. The results indicated a directional overall preference for the towels of the present invention as compared to the prior art sample of Example 3C, accompanied by parity ratings for softness and thickness, but statistically significant preference in not shredding/falling apart, speed of absorbency and amount absorbed as indicated below in Table 4.

TABLE 4

| Consumer Test Results | | | | | |
|---|---|---|---|---|---|
| Attribute | Example 3C | Example 5 | Example 7 | Comp U | Comp BI |
| Consumer Overall Rating | 2.9 | 3.2 | 3.1 | 2.7 | 2.9 |
| Consumer Thickness | 3.0 | 3.1 | 3.0 | 2.9 | 3.1 |
| Consumer Softness | 2.8 | 2.8 | 3.0 | 2.2 | 2.5 |
| Consumer Not Shredding/Falling Apart | 3.1 | 3.5 | 3.4 | 3.2 | 3.5 |
| Consumer Speed of Absorbency | 3.0 | 3.4 | 3.3 | 2.9 | 3.2 |
| Consumer Amount Absorbed | 3.1 | 3.4 | 3.2 | 2.9 | 3.1 |

While the invention has been described in connection with several examples and embodiments, modifications to those examples and embodiments within the spirit and scope of the invention will be readily apparent to those of skill in the art. In view of the foregoing discussion, relevant knowledge in the art and references including co-pending applications discussed above in connection with the Background and Detailed Description, the disclosures of which are all incorporated herein by reference, further description is deemed unnecessary.

What is claimed is:

1. A method of moist creping absorbent paper base sheet, the method comprising the steps of:

(a) forming a nascent web comprising at least a major proportion of recycled fibers, wherein at least a major portion of the recycled fibers, as determined on a length-weighted basis, exhibits flattened ribbonlike cellulosic fibers;

(b) applying a creping adhesive coating comprising an admixture of polyvinyl alcohol and a polyamide crosslinked with epichlorohydrin to a Yankee dryer;

(c) passing the nascent web through a nip defined between a suction pressure roll and the Yankee dryer;

(d) adhering an inner surface of the nascent web to the Yankee dryer with a controlled loading between the suction pressure roll and the Yankee dryer;

(e) drying the nascent web on the Yankee dryer to a desired moisture content;

(f) controlling, during the drying step, an outer surface of the nascent web to a web surface temperature of between about 110° C. and about 121° C., the web surface temperature being measured just prior to a creping step;

(g) creping the nascent web from the Yankee dryer with an undulatory creping blade bearing against the Yankee dryer, to form a moist biaxially undulatory web, a contact area between the undulatory creping blade and the Yankee dryer defining an undulatory ribbon shape across the width of the Yankee dryer;

(h) controlling, during the creping step, the web surface temperature to between about 110° C. and about 121° C.; and (i) following the creping step, drying the moist biaxially undulatory web to form a dry biaxially undulatory web.

2. The moist creping method of claim 1, further comprising controlling the steam pressure within the Yankee dryer, the dryer hood parameters, the Yankee dryer speed, the creping adhesive composition and the pressure with which the suction pressure roll bears against the Yankee dryer such that the basis weight of the dry biaxially undulatory web is between about 24 and 30 lbs/3000 $ft^2$, the caliper of the dry biaxially undulatory web exceeds 48 mils per 8 sheets, and, in a case in which the furnish comprises primarily unbleached fibers, the specific absorbency of the dry biaxially undulatory web is at least 2.2 g/g and the water absorbency rate (WAR) is less than 50 seconds, while in a case in which the furnish comprises primarily bleached fibers, the specific absorbency of the dry biaxially undulatory web is at least 2.0 g/g and the water absorbency rate (WAR) is less than 55 seconds.

3. The moist creping method of claim 2, wherein the geometric mean breaking length of the dry biaxially undulatory web is at most 1300 m.

4. The moist creping method of claim 3, wherein the machine direction bending length of the dry biaxially undulatory web is at least 3.0 cm and the geometric mean breaking length of the dry biaxially undulatory web is from about 900 m to about 1300 m.

5. The moist creping method of claim 4, wherein the basis weight of the dry biaxially undulatory web is between 24 and 30 lbs/3000 $ft^2$, the caliper of the dry biaxially undulatory web exceeds 50 mils per 8 sheets, the geometric mean breaking length of the dry biaxially undulatory web is at most 1250 m, and, in a case in which the furnish comprises primarily unbleached fibers, the specific absorbency of the dry biaxially undulatory web is at least 2.4 g/g and the water absorbency rate (WAR) is less than 45 seconds, while in a case in which the furnish comprises primarily bleached fibers, the specific absorbency is at least 2.2 g/g and the water absorbency rate (WAR) is less than 50 seconds.

6. The moist creping method of claim 5, wherein the cross-machine direction wet tensile of the dry biaxially undulatory web measured by the Finch Cup method is at least 650 g/3".

7. The moist creping method of claim 1, wherein the desired moisture content is from about 6 percent to about 9 percent.

8. The moist creping method of claim 1, wherein the web surface temperature during the drying step is controlled to between about 113° C. and about 118° C.

9. The moist creping method of claim 1, wherein the web surface temperature during the creping step is controlled to between about 113° C. and about 118° C.

10. A method of moist creping absorbent paper base sheet, the method comprising the steps of:

(a) forming a nascent web comprising at least a major proportion of recycled fibers, wherein at least a major portion of the recycled fibers, as determined on a length-weighted basis, exhibits flattened ribbonlike cellulosic fibers;

(b) applying a creping adhesive coating comprising an admixture of polyvinyl alcohol and a polyamide crosslinked with epichlorohydrin to a Yankee dryer;

(c) passing the nascent web through a nip defined between a suction pressure roll and the Yankee dryer;

(d) adhering an inner surface of the nascent web to the Yankee dryer with a pressure controlled by controlling the loading between the suction pressure roll and the Yankee dryer;

(e) drying the nascent web on the Yankee dryer to a desired moisture content;

(f) controlling, during the drying step, and outer surface of the nascent web to a web surface temperature of between about 110° C. and about 121° C., the web surface temperature being measured just prior to a creping step;

(g) creping the nascent web from the Yankee dryer with a creping blade bearing against the Yankee dryer to form a moist web;

(h) controlling, during the creping step, the web surface temperature to between about 110° C. and about 121° C.; and (i) following the creping step, drying the moist web to form a dry web.

11. The moist creping method of claim 10, further comprising controlling the steam pressure within the Yankee dryer, the dryer hood parameters, the Yankee dryer speed, the creping adhesive composition and the pressure with which the suction pressure roll bears against the Yankee dryer such that the basis weight of the dry web is less than 30 lbs/3000 $ft^2$, the caliper of the dry web exceeds 48 mils per 8 sheets, the water absorbency rate (WAR) is less than 50 seconds, the geometric mean breaking length of the dry web is from about 900 m to about 1300 m, and the specific absorbency of the dry web is at least 2.45 g/g, in a case in which the web comprises primarily unbleached fibers, and is at least about 2.25 g/g, in a case in which the web comprises primarily bleached fibers.

12. The moist creping method of claim 11, wherein the machine direction bending length of the dry web is at least 3.0 cm and the geometric mean breaking length of the dry web is from about 1050 m to about 1250 m.

13. The moist creping method of claim 10, wherein the basis weight of the dry web is between 24 and 29 lbs/3000 $ft^2$, the caliper of the dry web exceeds 50 mils per 8 sheets, the geometric mean breaking length of the dry web is at most 1250 m, the water absorbency rate (WAR) is less than 45 seconds, and the specific absorbency of the dry web is at least 2.5 g/g, in a case in which the web comprises primarily unbleached fibers, and is at least 2.3 g/g, in a case in which the web comprises primarily bleached fibers.

14. The moist creping method of claim 13, wherein the cross-machine direction wet tensile of the dry web measured by the Finch Cup method is at least 650 g/3".

15. The moist creping method of claim 10, wherein the web comprises at least about 75% of flattened ribbonlike fibers, as determined on a length-weighted basis.

16. The moist creping method of claim 10, wherein the web comprises at least about 90% of flattened ribbonlike fibers, as determined on a length-weighted basis.

17. The moist creping method of claim 10, wherein the desired moisture content is from about 6 percent to about 9 percent.

18. The moist creping method of claim 10, wherein the web surface temperature during the drying step is controlled to between about 113° C. and about 118° C.

19. The moist creping method of claim 10, wherein the web surface temperature during the creping step is controlled to between about 113° C. and about 118° C.

20. A method of moist creping absorbent paper base sheet, the method comprising the steps of:

(a) forming a nascent web comprising at least a major proportion of recycled cellulosic fibers;
(b) applying a creping adhesive coating comprising an admixture of polyvinyl alcohol and a polyamide crosslinked with epichlorohydrin to a Yankee dryer;
(c) passing the nascent web through a nip defined between a suction pressure roll and the Yankee dryer;
(d) adhering an inner surface of the nascent web to the Yankee dryer with a pressure controlled by controlling the loading between the suction pressure roll and the Yankee dryer;
(e) drying the nascent web on the Yankee dryer to a desired moisture content;
(f) controlling, during the drying step, an outer surface of the nascent web to a web surface temperature of between about 110° C. and about 121° C., the web surface temperature being measured just prior to a creping step;
(g) creping the nascent web from the Yankee dryer with an undulatory creping blade bearing against the Yankee dryer, to form a moist biaxially undulatory web, the contact area between the undulatory creping blade and the Yankee dryer defining an undulatory ribbon shape across the width of the Yankee dryer;
(h) controlling, during the creping step, the web surface temperature to between about 110° C. and about 121° C.; and
(i) following the creping step, drying the moist biaxially undulatory web to form a dried web having a geometric mean breaking length of between about 900 m and 1350 m.

21. The moist creping method of claim 20, further comprising controlling the steam pressure within the Yankee dryer, the dryer hood parameters, the Yankee dryer speed, the creping adhesive composition and the pressure with which the suction pressure roll bears against the Yankee dryer such that the basis weight of the dried web is less than 30 lbs/3000 $ft^2$, the caliper of the dried web exceeds 48 mils per 8 sheets, the water absorbency rate (WAR) is less than 50 seconds, and the specific absorbency of the dried web is at least 2.25 g/g, in a case in which the web comprises primarily unbleached fibers, and at least 2.05 g/g, in a case in which the web comprises primarily bleached fibers.

22. The moist creping method of claim 20, wherein the geometric mean breaking length of the dried web is from about 900 m to about 1300 m.

23. The moist creping method of claim 22, wherein the machine direction bending length of the dried web is at least 3 cm, and the geometric mean breaking length of the dried web is from about 1050 m to about 1250 m.

24. The moist creping method of claim 20, wherein the basis weight of the dried web is between 24 and 30 lbs/3000 $ft^2$, the caliper of the dried web exceeds 50 mils per 8 sheets, the geometric mean breaking length of the dried web is at most 1250 m, the water absorbency rate (WAR) is less than 45 seconds, and the specific absorbency of the dried web is at least 2.35 g/g, in a case in which the biaxially undulatory web comprises primarily unbleached fibers, and at least about 2.15 g/g, in a case in which the biaxially undulatory web comprises primarily bleached fibers.

25. The moist creping method of claim 24, wherein the cross-machine direction wet tensile of the dried web measured by the Finch Cup method is at least 650 g/3".

26. The moist creping method of claim 25, wherein the web comprises at least about 1.5% ash by weight and at least about 10% non-hardwood fibers having an average fiber length of less than about 0.2 mm, as determined on a weight weighted basis.

27. The moist creping method of claim 20, wherein at least a major portion of the recycled fibers, as determined on a length-weighted basis, exhibits flattened ribbonlike cellulosic fibers.

28. The moist creping method of claim 20, wherein the desired moisture content is from about 6 percent to about 9 percent.

29. The moist creping method of claim 20, the web surface temperature during the drying step is controlled to between about 113° C. and about 118° C.

30. The moist creping method of claim 20, wherein the web surface temperature during the creping step is controlled to between about 113° C. and about 118° C.

31. A method of moist creping absorbent paper base sheet, the method comprising the steps of:

(a) forming a nascent web comprising at least a major proportion of recycled cellulosic fibers;
(b) applying a creping adhesive coating comprising an admixture of polyvinyl alcohol and a polyamide crosslinked with epichlorohydrin to a Yankee dryer;
(c) passing the nascent web through a nip defined between a suction pressure roll and the Yankee dryer;
(d) adhering an inner surface of the nascent web to the Yankee dryer with a controlled loading between the suction pressure roll and the Yankee dryer;
(e) drying the nascent web on the Yankee dryer to a desired moisture content;
(f) controlling, during the drying step, an outer surface of the nascent web to a web surface temperature of between about 107° C. and about 124° C., the web surface temperature being measured just prior to a creping step;
(g) creping the nascent web from the Yankee dryer with an undulatory creping blade bearing against the Yankee dryer to form a moist web;
(h) controlling, during the creping step, the web surface temperature to between about 107° C. and about 124° C.;
(i) following the creping step, drying the moist web; and
(j) recovering a web comprising at least about 1.5% ash by weight and at least about 10% non-hardwood fibers, having an average fiber length of less than about 0.2 mm on a weight weighted basis, wherein the recovered web has a geometric mean breaking length between 900 m and 1350 m, the water absorbency rate (WAR) of the recovered web is less than 50 seconds and the specific absorbency is at least 2.3 g/g, in a case in which the web comprises primarily unbleached fibers, and at least about 2.1 g/g, in a case in which the web comprises primarily bleached fibers.

32. The moist creping method of claim 31, further comprising controlling the steam pressure within the Yankee dryer, the dryer hood parameters, the Yankee dryer speed, the creping adhesive composition and the pressure with which the suction pressure roll bears against the Yankee dryer such that the basis weight of the recovered web is less than 30 lbs/3000 $ft^2$, the caliper of the recovered web exceeds 48 mils per 8 sheets, the water absorbency rate (WAR) is less than 50 seconds, and the specific absorbency of the recovered web is at least 2.45 g/g, in a case in which the web comprises primarily unbleached fibers, and at least about 2.15 g/g, in a case in which the web comprises primarily bleached fiber.

33. The moist creping method of claim 32, wherein the machine direction bending length of the recovered web is at least 3.0 cm and the geometric mean breaking length of the recovered web is from about 1050 m to about 1250 m.

34. The moist creping method of claim 33, wherein the basis weight of the recovered web is between 26 and 30 lbs/3000 $ft^2$, the caliper of the recovered web exceeds 50 mils per 8 sheets, the water absorbency rate (WAR) is less than 45 seconds, the geometric mean breaking length of the recovered web is at most 1250 m, and the specific absorbency of the recovered web is at least 2.45 g/g, in a case in which the web comprises primarily unbleached fibers, and at least about 2.25 g/g, in a case in which the web comprises primarily bleached fiber.

35. The moist creping method of claim 34, wherein the cross-machine direction wet tensile of the recovered web measured by the Finch Cup method is at least 800 g/3".

36. The moist creping method of claim 35, wherein the recovered web comprises at least about 1.5% ash by weight and at least about 10% non-hardwood fibers having a fiber length of less than about 0.2 mm, as determined on a length-weighted basis.

37. The moist creping method of claim 31, wherein at least a major portion of the recycled fibers, as determined on a length-weighted basis, exhibits flattened ribbonlike cellulosic fibers.

38. The moist creping method of claim 31, wherein the desired moisture content is from about 6 percent to about 9 percent.

39. The moist creping method of claim 31, the web surface temperature during the drying step is controlled to between about 113° C. and about 118° C.

40. The moist creping method of claim 31, the web surface temperature during the creping step is controlled to between about 113° C. and about 118° C.

41. A method of moist creping absorbent paper base sheet, the method comprising the steps of:

(a) forming a nascent web comprising at least a major proportion of recycled cellulosic fibers;

(b) applying a creping adhesive coating to a Yankee dryer;

(c) passing the nascent web through a nip defined between a suction pressure roll and the Yankee dryer;

(d) adhering an inner surface of the nascent web to the Yankee dryer with a pressure controlled by controlling the loading between the suction pressure roll and the Yankee dryer;

(e) drying the nascent web on the Yankee dryer to a desired moisture content;

(f) controlling, during the drying step, an outer surface of the nascent web to a web surface temperature of between about 107° C. and about 124° C., the web surface temperature being measured just prior to a creping step;

(g) creping the nascent web from the Yankee dryer with an undulatory creping blade bearing against the Yankee dryer to form a moist biaxially undulatory web, the contact area between the undulatory creping blade and the Yankee dryer defining an undulatory ribbon shape across the width of the Yankee dryer;

(h) controlling, during the creping step, the web surface temperature to between about 110° C. and about 121° C.;

(i) following the creping step, drying the moist biaxially undulatory web; and (j) recovering a web comprising at least about 3% ash by weight and at least about 10% non-hardwood fibers having an average fiber length of less than about 0.2 mm on a weight weighted basis, wherein the geometric mean breaking length of the recovered web is between 900 and 1350 m, and the specific absorbency of the recovered web is at least 2.55 g/g, in a case in which the web comprises primarily unbleached fibers, and at least about 2.35 g/g, in a case in which the web comprises primarily bleached fibers.

42. The moist creping method of claim 41, further comprising controlling the steam pressure within the Yankee dryer, the dryer hood parameters, the Yankee dryer speed, the creping adhesive composition and the pressure with which the suction pressure roll bears against the Yankee dryer such that the basis weight of the recovered web is less than 30 lbs/3000 $ft^2$, the caliper of the recovered web exceeds 48 mils per 8 sheets, the geometric mean breaking length of the recovered web is from about 1000 m to about 1300 m, the water absorbency rate (WAR) of the recovered web is less than 50 seconds, and the specific absorbency is at least 2.6 g/g, in a case in which the web comprises primarily unbleached fibers, and at least about 2.4 g/g, in a case in which the web comprises primarily bleached fibers.

43. The moist creping method of claim 42, wherein the machine direction bending length of the recovered web is at least 3.0 cm and the geometric mean breaking length of the recovered web is from about 1050 m to about 1250 m.

44. The moist creping method of claim 43, wherein the basis weight of the recovered web is between 24 and 30 lbs/3000 $ft^2$, the caliper of the recovered web exceeds 50 mils per 8 sheets, the geometric mean breaking length of the recovered web is at most 1250 m, the water absorbency rate (WAR) is less than 45 seconds, and the specific absorbency of the recovered web is at least 2.6 g/g, in a case in which the web comprises primarily unbleached fibers, and at least about 2.4 g/g, in a case in which the web comprises primarily bleached fibers.

45. The moist creping method of claim 41, wherein at least a major portion of the recycled fibers, as determined on a length-weighted basis, exhibits flattened ribbonlike cellulosic fibers.

46. The moist creping method of claim 41, wherein the desired moisture content is from about 6 percent to about 9 percent.

47. The moist creping method of claim 41, wherein the web surface temperature during the drying step is controlled to between about 113° C. and about 118° C.

48. The moist creping method of claim 41, the web surface temperature during the creping step is controlled to between about 113° C. and about 118° C.

* * * * *